US007700254B2

(12) United States Patent
Moribe et al.

(10) Patent No.: US 7,700,254 B2
(45) Date of Patent: Apr. 20, 2010

(54) TONER WITH SPECIFIED AMOUNTS OF THE THF-SOLUBLE MATTER HAVING CERTAIN INTRINSIC VISCOSITY

(75) Inventors: Syuhei Moribe, Numazu (JP); Katsuhisa Yamazaki, Numazu (JP); Daisuke Yoshiba, Suntou-gun (JP); Hirata Junko, Suntou-gun (JP); Masami Fujimoto, Suntou-gun (JP); Takashige Kasuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/056,917

(22) Filed: Mar. 27, 2008

(65) Prior Publication Data

US 2008/0187853 A1 Aug. 7, 2008

Related U.S. Application Data

(63) Continuation of application No. PCT/JP2007/069830, filed on Oct. 11, 2007.

(30) Foreign Application Priority Data

Oct. 11, 2006 (JP) ..... 2006-277384

(51) Int. Cl.
*G03G 9/087* (2006.01)

(52) U.S. Cl. ..... 430/109.3; 430/109.4; 430/111.4

(58) Field of Classification Search ..... 430/109.3, 430/109.4, 111.4
See application file for complete search history.

(56) References Cited

U.S. PATENT DOCUMENTS

| | | | | |
|---|---|---|---|---|
| 5,736,288 | A | 4/1998 | Kasuya et al. | 430/106.6 |
| 5,814,429 | A | 9/1998 | Kawakami et al. | 430/124 |
| 5,858,596 | A | 1/1999 | Tajima et al. | 430/110 |
| 5,908,727 | A | 6/1999 | Kawaji et al. | 430/110 |
| 6,235,441 | B1 | 5/2001 | Tanikawa et al. | 430/106 |
| 6,300,024 | B1 | 10/2001 | Yusa et al. | 430/45 |
| 6,447,970 | B1 | 9/2002 | Matsunaga et al. | |
| 6,485,875 | B1 | 11/2002 | Karaki et al. | 430/108.23 |

(Continued)

FOREIGN PATENT DOCUMENTS

| | | |
|---|---|---|
| JP | 55-153944 | 12/1980 |

(Continued)

*Primary Examiner*—Christopher RoDee
(74) *Attorney, Agent, or Firm*—Fitzpatrick, Cella, Harper & Scinto

(57) ABSTRACT

The present invention aims to provide a toner having excellent developability and excellent low-temperature fixability without causing adhesion of ejected sheets even in a high-speed oilless fixing system and capable of preventing a frameless printing from causing a twisted offseting phenomenon. Specifically, provided is a toner having toner particles including at least a binder resin and a colorant, in which, when the toner is dissolved in a tetrahydrofuran (THF) solvent at 25° C. for 24 hours, the ratio of a THF-soluble matter having an intrinsic viscosity of $5.0\times10^{-2}$ dl/g or less with respect to the total amount of the THF-soluble matter in a GPC-RALLS-viscometer analysis is 15.0 mass % to 60.0 mass %, and the ratio of a THF-soluble matter having an intrinsic viscosity of $1.5\times10^{-1}$ dl/g or more with respect to the total amount of the THF-soluble matter in a GPC-RALLS-viscometer analysis is 20.0 mass % to 40.0 mass %.

7 Claims, 4 Drawing Sheets

U.S. PATENT DOCUMENTS

| | | | | |
|---|---|---|---|---|
| 6,881,527 | B2 | 4/2005 | Moribe et al. | 430/109.4 |
| 6,946,228 | B2 | 9/2005 | Kanamaru et al. | 430/108.4 |
| 7,001,703 | B2 | 2/2006 | Moribe et al. | 430/109.4 |
| 7,097,951 | B2 | 8/2006 | Moribe et al. | 430/108.3 |
| 7,267,919 | B2 | 9/2007 | Moribe et al. | 430/108.23 |
| 7,351,509 | B2 | 4/2008 | Moribe et al. | 430/108.8 |
| 2005/0100808 | A1* | 5/2005 | Hashimoto et al. | 430/108.8 |
| 2006/0240352 | A1 | 10/2006 | Ogawa et al. | 430/109.3 |
| 2007/0026336 | A1 | 2/2007 | Yamazaki et al. | 430/109.3 |
| 2007/0105033 | A1 | 5/2007 | Moribe et al. | 430/109.3 |
| 2007/0141499 | A1 | 6/2007 | Yamazaki et al. | 430/109.3 |

FOREIGN PATENT DOCUMENTS

| | | |
|---|---|---|
| JP | 07-101318 | 4/1995 |
| JP | 09-073187 | 3/1997 |
| JP | 10-087839 | 4/1998 |
| JP | 2000-275908 | 10/2000 |
| JP | 2000-314983 | 11/2000 |
| JP | 2001-022115 | 1/2001 |
| JP | 2001154418 | 6/2001 |
| JP | 2001356526 | 12/2001 |
| JP | 2002049177 | 2/2002 |
| JP | 2003-098915 | 4/2003 |
| JP | 2004-045457 | 2/2004 |
| JP | 2005134751 | 5/2005 |
| JP | 2005173063 | 6/2005 |

* cited by examiner

TONER WITH SPECIFIED AMOUNTS OF THE THF-SOLUBLE MATTER HAVING CERTAIN INTRINSIC VISCOSITY

BACKGROUND OF THE INVENTION

1. Field of the Invention

The present invention relates to a toner for use in an image forming method intended for visualizing an electrophotograph, or an electrostatic charge image.

2. Description of the Related Art

A large number of image forming methods such as an electrostatic recording method, a magnetic recording method, and a toner jet method have been conventionally known. The electrostatic recording method generally involves: utilizing a photoconductive substance to form an electrostatic latent image on a photosensitive member by various means; next, developing the latent image with toner to provide a visible image; transferring the toner onto a transfer material such as paper as required; and then fixing the toner image onto the transfer material by using heat, pressure, or the like to provide a copied article. The toner remaining on the photosensitive member without being transferred is cleaned by various methods, and then the above-mentioned steps are repeated.

Various methods and devices have been developed for the step of fixing the toner image onto a sheet such as paper, as the above-mentioned final step. The method most commonly used in recent years is a pressure heating mode using a fixing roller. The pressure heating mode using a fixing roller involves passing the transfer material while bringing surfaces of a pressure roller and the heat roller having releasability with respect to toner and a surface of a toner image on the transfer material into contact with each other under pressure to fix the toner image. In the mode, the surface of the fixing roller and the toner image on the transfer material are brought into contact with each other under pressure, so the mode provides extremely good thermal efficiency upon fusion of the toner image onto the transfer material, and allows fixation to be quickly performed. However, in the above method, the surface of the fixing roller is brought into contact with the toner image in a molten state under pressure. Thus, part of the toner image may be adhered on and transferred to the surface of the fixing roller and then retransferred to a subsequent sheet to be fixed. As a result, it may cause a so-called offsetting phenomenon and contaminate the fixing sheet. Therefore, the heat roller fixing system has been required to prevent the toner from adhering on the surface of the fixing roller.

Accordingly, for the purpose of preventing toner from adhering on the surface of a fixing roller, for example, the roller surface has been formed with a material (such as a silicon rubber or a fluorine-based resin) which is excellent in releasability with respect to the toner. Further, the surface of the roller has been covered with a thin film made of a liquid having high releasability, such as silicone oil or fluorine oil, to prevent an offset from occurring and to prevent the surface of the roller from fatigue. However, this method is very effective in preventing the offset of toner but requires a device for supplying an offset-preventing liquid. Thus, the method has a problem of a complicated fixing device and also a problem of causing a detachment between the layers constituting a fixing roller due to the application of oil. As a result, the method has been always accompanied by an adverse effect of facilitating the shortening of the life of the fixing roller.

Further, it has a high potential for an evaporation of silicone oil or the like with heat to cause problems of contaminating the inside the device, treating collected oil, and so on. Thus, instead of using a device for supplying silicone oil, or the like, in consideration of supplying from toner a liquid for preventing an offset from occurring upon heating, some documents (for example, JP 55-153944 A and JP 09-73187 A) disclose a method of adding a substance having a releasability, such as low-molecular weight polyethylene and low-molecular weight polypropylene, to the toner. However, the addition of such an additive in large amount to exert a sufficient effect may cause actual problems: a filming phenomenon to a photosensitive member; and surface contamination of toner carrying members, such as a carrier and a sleeve, because of resulting in image deterioration. Thus, a small amount of wax not enough to cause image deterioration is added to toner in combination of the use of a device that utilizes a member (such as web-like member) for supplying a small amount of releasable oil or rolling up an offset toner or a device that utilizes a cleaning pad for cleaning. However, considering the latest demands of miniaturization, weight-saving, and high-reliability, it is desirable and preferable to remove these auxiliary devices. Therefore, further improvements in properties of toner fixation, offset, and soon should be required as countermeasures. However, such improvements are hardly realized as far as further improvements in binder resin, wax, and the like of toner are not achieved.

Further, in recent years, opportunities have increased to output image data incorporated by digital cameras, digital video cameras, portable terminals, and the like or output graphic images such as posters from image-forming apparatuses, such as copying machines and digital LBPs. Therefore, there is an increased need of generating the output of an image all over the sheet of paper in a manner similar to the quick-printing or development of the conventional optical film camera. For coping with the needs from market, the addition of an image-forming mechanism corresponding to a whole-surface frameless image has been proposed (see, for example, JP2003-98915A and JP2004-45457A). In the case of an image formation corresponding to a whole-surface frameless image, in particular when a recording material having no margin on the edge thereof is rushed into a fixing nip part, there is a tendency of generating a so-called "twisted offsetting phenomenon" in which a toner image on the recording material is not separated from a heat member.

Further, in the case of responding to a request for speeding-up in recent years, in addition to speeding up the transfer of a recording material, the distance (paper gap) between the sheets of the recording material to be fed one by one tends to become shorter. In addition, the temperature of the recording material discharged after the fixation becomes very high. In general, after the fixation, the recording material is discharged from a discharge roller and then mounted on a discharge tray or a stacker capable of carrying the sheets of the recording material in large numbers. Therefore, when the large numbers of the sheet of the recording material being heated at high temperature are mounted on the stacker in a short time, the once-fixed toner is melted by re-accumulated heat, thereby, a phenomenon in which the sheets of the recording material may be adhered together (hereinafter, referred to as a discharged paper adhesion) occurs. Thus, there is a problem in which the qualities of an image formed may be deteriorated.

In order to solve the above problems, methods in which a styrene resin and a polyester resin are grafted with wax have been disclosed (see, for example, JP 07-101318 A, JP 2000-314983 A, and JP 2001-022115 A). In addition, methods, in which a resin obtained by reaction of a polyester resin with part of a styrene resin is used, have been also disclosed (see, for example, JP10-087839 A and JP 2000-275908 A). However, the toner satisfactory overcoming all of those problems has not been provided so far.

SUMMARY OF THE INVENTION

Problems to be Solved by the Invention

The present invention provides a toner having excellent developability and excellent low-temperature fixability without causing adhesion of ejected sheets even in a high-speed oilless fixing system and capable of preventing a frameless printing from causing a twisted offsetting phenomenon.

Means for Solving Problem

The inventors of the present invention have intensively studied and finally solved the above problems by defining the ratio of an intrinsic viscosity in the GPC-RALLS-viscometer analysis of a THF-soluble matter obtained by dissolving a toner in a THF solvent at 25° C. for 24 hours.

That is, the present invention is as follows:

(1) a toner comprising toner particles comprising at least a binder resin and a colorant, in which, when the toner is dissolved in a tetrahydrofuran (THF) solvent at 25° C. for 24 hours, the ratio of a THF-soluble matter having an intrinsic viscosity of $5.0\times10^{-2}$ dl/g or less with respect to the total amount of the THF-soluble matter in a GPC-RALLS-viscometer analysis is 15.0 mass % to 60.0 mass %, and the ratio of a THF-soluble matter having an intrinsic viscosity of $1.5\times10^{-1}$ dl/g or more with respect to the total amount of the THF-soluble matter in a GPC-RALLS-viscometer analysis is 20.0 mass % to 40.0 mass %.

(2) a toner according to Item (1), in which, when the toner is dissolved in a THF solvent at 25° C. for 24 hours, an intrinsic viscosity of a THF-soluble matter having an absolute molecular weight of $1.5\times10^{4}$ in a GPC-RALLS-viscometer analysis is $5.0\times10^{-3}$ dl/g to $1.0\times10^{-1}$ dl/g.

(3) a toner according to Item (1) or (2), in which, when the toner is dissolved in a THF solvent at 25° C. for 24 hours, an intrinsic viscosity of a THF-soluble matter having an absolute molecular weight of $1.0\times10^{5}$ in a GPC-RALLS-viscometer analysis is $1.0\times10^{-1}$ dl/g to $2.0\times10^{-1}$ dl/g.

(4) a toner according to any one of Items (1) to (3), in which, when the toner is dissolved in a THF solvent at 25° C. for 24 hours, an intrinsic viscosity of a THF-soluble matter having an absolute molecular weight of $1.5\times10^{4}$ in a GPC-RALLS-viscometer analysis is $1.0\times10^{-2}$ dl/g to $6.0\times10^{-2}$ dl/g.

(5) a toner according to any one of Items (1) to (4), in which, when the toner is dissolved in a THF solvent at 25° C. for 24 hours, an intrinsic viscosity of a THF-soluble matter having an absolute molecular weight of $1.0\times10^{5}$ in a GPC-RALLS-viscometer analysis is $1.2\times10^{-1}$ dl/g to $2.0\times10^{-1}$ dl/g.

(6) a toner according to any one of Items (1) to (5), in which the binder resin comprise at least a hybrid resin in which a polyester unit and a vinyl copolymerization unit are chemically bound.

Effect of the Invention

The present invention provides a toner having an excellent developability and an excellent low-temperature fixability without causing adhesion of ejected sheets even in a high-speed oilless fixing system and capable of preventing a frameless printing from causing a twisted offsetting phenomenon.

DESCRIPTION OF THE EMBODIMENTS

Figure 1:
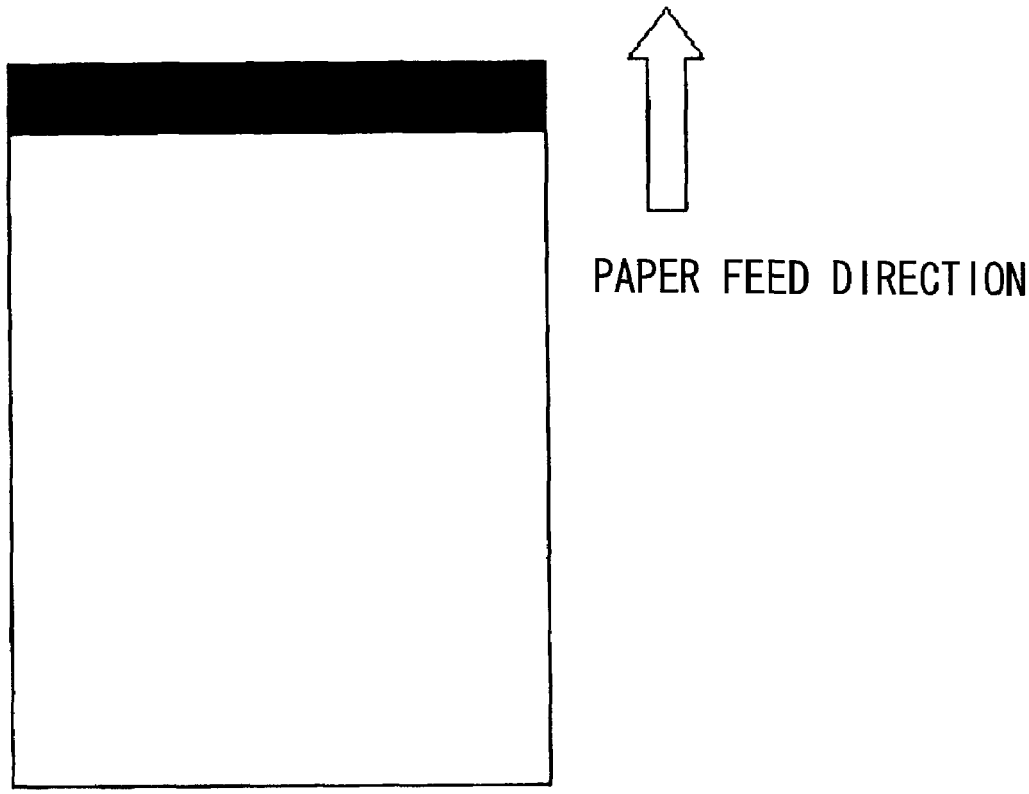
FIG. 1 is a diagram illustrating an image (print ratio: 10%) used in an evaluation of a twisted offset.

Hereinafter, the present invention will be described in detail.

The toner of the present invention is a toner comprising toner particles comprising at least a binder resin and a colorant, which is characterized in that, when the toner is dissolved in a tetrahydrofuran (THF) solvent at 25° C. for 24 hours, the ratio of a THF-soluble matter having an intrinsic viscosity of $5.0\times10^{-2}$ dl/g or less to the total amount of the THF-soluble matter in a GPC-RALLS-viscometer analysis is 15.0 mass % to 60.0 mass %, and the ratio of a THF-soluble matter having an intrinsic viscosity of $1.5\times10^{-1}$ dl/g or more to the total amount of the THF-soluble matter in a GPC-RALLS-viscometer analysis is 20.0 mass % to 40.0 mass %. Further, the intrinsic viscosity of the THF-soluble matter in the GPC-RALLS-viscometer analysis when the toner is dissolved in the tetrahydrofuran (THF) solvent at 25° C. for 24 hours will be simply referred to as "intrinsic viscosity" in the following description.

Conventionally, in order to enhance the releasability of toner, there is employed a method of adding wax or the like to toner or supplying a gel component to toner. However, the fixability and developability of toner have been affected in many cases even the releasability is improved. Thus, the fixability, developability, and releasability of toner have not been attained at once.

Therefore, as a result of intensive studies, the inventors of the present invention have finally developed a toner having a desired releasability and causing no discharged paper adhesion while satisfying both the fixability and the developability even in the frameless printing by defining the viscosity distribution of toner. The intrinsic viscosity defined in the present invention is the viscosity of a THF-soluble matter when a toner is dissolved in a THF solvent at 25° C. for 24 hours. Thus, it is provided as an index completely different from the definition about viscosity for the conventional viscoelasticity. The definition for the conventional viscoelasticity refers to a viscosity with the inclusion of THF-insoluble components such as a gel component, a wax component, and a colorant. In contrast, an intrinsic viscosity used in the present invention refers to any component soluble in a THF solvent, which is mainly the intrinsic viscosity of a resin component in the toner. Most of the components which contribute to the fixability of the toner are resin components in the toner. Thus, the releasability of the toner can be more directly represented by defining the intrinsic viscosity of the resin component. Any component having an intrinsic viscosity of $5.0\times10^{-2}$ dl/g or less may be principally a component which contributes to low-temperature fixability. On the other hand, any component having an intrinsic viscosity of $1.5\times10^{-1}$ dl/g or more may be a component which contributes to the releasability of toner. It is important that both the above components exit in the toner at a predetermined ratio. In other words, at the time of fixation, a component with a high melting rate and a low intrinsic viscosity can be selectively melted at first. Then, a component with a low melting rate and a high intrinsic viscosity can be melted. Thus, the surface of toner is covered with the component with the high intrinsic viscosity, so the releasability thereof can be increased. Therefore, for attaining the effects of the present invention, it is important to define the specific intrinsic viscosities of the components to make a difference in melting rates in the toner.

The ratio of an intrinsic viscosity of $5.0\times10^{-2}$ dl/g or less in the toner of the present invention is 15.0 mass % to 60.0 mass % (preferably 15.0 mass % to 50.0 mass %, more preferably 15.0 mass % to 30.0 mass %, and still more preferably 15.0 mass % to 25.0 mass %). And The ratio of an intrinsic viscosity of $1.5\times10^{-1}$ dl/g or more in the toner of the present invention is 20.0 mass % to 40.0 mass % (preferably 22.0 mass % to 38.0 mass %, more preferably 22.0 mass % to 35.0 mass %, and still more preferably 25.0 mass % to 35.0 mass %). When the ratio of the intrinsic viscosity of $5.0\times10^{-2}$ dl/g or less is less than 15.0 mass %, fixability degrades in a light-pressure high-speed developing system that requires a component having a high melting rate. When the above ratio exceeds 60.0 mass %, the twisted offset property upon non-margin printing degrades. On the other hand, when the ratio of the intrinsic viscosity of $1.5\times10^{-1}$ dl/g or more is less than 20.0 mass %, then the adhesion property of ejected sheets degrades due to a decrease in high-viscosity component on the surface of melting toner. When the above ratio exceeds 40.0 mass %, the fixability degrades.

Further, the toner of the present invention has: when the toner is dissolved in a tetrahydrofuran (THF) solvent at 25° C. for 24 hours, an intrinsic viscosity of a THF-soluble matter having an absolute molecular weight of $1.5\times10^{4}$ in the GPC-RALLS-viscometer analysis is preferably $5.0\times10^{-3}$ dl/g to $1.0\times10^{-1}$ dl/g, more preferably $5.0\times10^{-3}$ dl/g to $8.0\times10^{-2}$ dl/g, still more preferably $1.0\times10^{-2}$ dl/g to $6.0\times10^{-2}$ dl/g, and most preferably $1.0\times10^{-2}$ dl/g to $5.0\times10^{-2}$ dl/g; and when the toner is dissolved in a tetrahydrofuran (THF) solvent at 25° C. for 24 hours, an intrinsic viscosity of a THF-soluble matter having an absolute molecular weight of $1.0\times10^{5}$ in the GPC-RALLS-viscometer analysis is preferably $1.0\times10^{-1}$ dl/g to $2.0\times10^{-1}$ dl/g, more preferably $1.2\times10^{-1}$ dl/g to $2.0\times10^{-1}$ dl/g, still more preferably $1.4\times10^{-1}$ dl/g to $1.8\times10^{-1}$ dl/g, and most preferably $1.5\times10^{-1}$ dl/g to $1.8\times10^{-1}$ dl/g.

Because the intrinsic viscosity varies depending on the type of resin and the type of monomer even in the case of a constant absolute molecular weight, this is an index for representing such a matter. Even in the case of those having the same absolute molecular weight of $1.5\times10^{4}$, one using a monomer type or a resin type having a lower viscosity shows a lower intrinsic viscosity. As the absolute molecular weight of $1.5\times10^{4}$ corresponds to almost the main peak molecular weight of the toner of the present invention, it may be the most abundant component in terms of the amount of the component. When the intrinsic viscosity of one having an absolute molecular weight of $1.5\times10^{4}$ is less than $5.0\times10^{-3}$ dl/g, a component having a lower intrinsic viscosity becomes a principle component among the THF-soluble components in the toner, with the result that the offset resistance may be decreased. On the other hand, when the intrinsic viscosity of one having an absolute molecular weight of $1.5\times10^{4}$ is more than $1.0\times10^{-1}$ dl/g, a component having a higher intrinsic viscosity becomes a principle component among the THF-soluble components in the toner, with the result that the fixability may be decreased. Further, in the THF-soluble component in the toner, a component having a higher intrinsic viscosity becomes a principle component, so the property of mixing with other components such as a charge control agent deteriorates and the developability may be decreased due to ununiform electrification.

Further, the absolute molecular weight of $1.0\times10^{5}$ is a molecular weight region that represents a high-molecular weight component in the toner. Thus, the intrinsic viscosity of the absolute-molecular-weight region affects on the releasability. When an intrinsic viscosity at the absolute molecular weight of $1.0\times10^{5}$ is less than $1.0\times10^{-1}$ dl/g, the intrinsic viscosity of the high-molecular weight component becomes too small, with the result that the releasability may be decreased and a resistance to twisted offset may be decreased. When an intrinsic viscosity at the absolute molecular weight of $1.0\times10^{5}$ is larger than $2.0\times10^{-1}$ dl/g, the intrinsic viscosity of the high-molecular weight component becomes too large, with the result that an ability of mixing with a low viscosity component may degrade. Besides, in the case of carrying out a long-term endurance in a web-less fixing system, due to a low-viscosity component is gradually accumulated on the surface of a fixing roll, image defects such as the generation of black dots may be generated on the printed image at last half of the long-term endurance.

A molecular weight Mp of a THF-soluble matter at the peak top of a main peak in the GPC-RALLS-viscometer analysis, when the above toner is dissolved in a THF solvent at 25° C. for 24 hours, is preferably 8,000 to 30,000, more preferably 12,000 to 26,000, and particularly preferably 18,000 to 24,000. When the molecular weight Mp at the peak top of the above main peak is smaller than 8,000, the viscosity of the whole toner decreases and may result in a decline in twisted-offset resistance. In contrast, when it exceeds 30,000, the fixability may be declined.

A weight average molecular weight Mw of the absolute molecular weights of a THF-soluble matter in the GPC-RALLS-viscometer analysis, when the above toner is dissolved in a THF solvent at 25° C. for 24 hours, is preferably $3.00\times10^{5}$ to $2.00\times10^{6}$, more preferably $5.00\times10^{5}$ to $1.00\times10^{6}$, and particularly preferably $6.00\times10^{5}$ to $9.00\times10^{5}$. When the weight average molecular weight Mw of the absolute molecular weight is smaller than $3.00\times10^{5}$, it may result in a decline in twisted-offset resistance. When the weight average molecular weight Mw of the absolute molecular weight is larger than $2.00\times10^{6}$, the fixability may be declined.

Further, Mw/Mn, which represents a molecular weight distribution of the absolute molecular weights of a THF-soluble matter in the GPC-PALLS-viscometer analysis, when the above toner is dissolved in a THF solvent at 25° C. for 24 hours, is preferably 20.0 to 60.0, more preferably 30.0 to 50.0, and particularly preferably 30.0 to 45.0 from a standpoint of the compatibility of fixability with the twisted-offset resistance.

Further, the inertial square radius Rg of a THF-soluble matter in the GPC-RALLS-viscometer analysis, when the above toner is dissolved in a THF solvent at 25° C. for 24 hours, is preferably 5.0 nm to 30.0 nm, more preferably 8.0 nm to 20.0 nm, and particularly preferably 10.0 nm to 16.0 nm. When the above inertial square radius Rg is less than 5.0 nm, the molecular weight is small or the extent of branching is too large. In the former case, the releasability may be deteriorated. In the latter case, the fixability may be deteriorated because the toner is too hard. On the other hand, when the above inertial square radius Rg is larger than 30.0 nm, the molecular weight is too large or the extent of branching is too small. The former case leads to a decrease in fixability. In the latter case, a long-chain alkyl monomer added is combined insufficiently, which results in a free monomer, thereby causing deterioration in storage stability in some cases.

A glass-transition temperature (Tg) of the above-mentioned toner is preferably 40.0 to 70.0° C., more preferably 45.0 to 65.0° C., and still more preferably 50.0 to 60.0° C. When Tg is lower than 40.0° C., storage stability is apt to deteriorate. When Tg exceeds 70.0° C., fixability is apt to deteriorate.

In addition, a softening point (Tm) of the toner is preferably 90.0 to 140.0° C., more preferably 95.0 to 130.0° C., and still more preferably 95.0 to 125.0° C. from the viewpoint of fixability.

Further, an amount of THF-insoluble matter in the above toner is preferably 0 mass % to 40.0 mass %, more preferably 5.0 mass % to 30.0 mass % in view of fixability.

The binder resin to be used in the present invention desirably contains at least a polyester unit. In general, the binder resin is more preferably a hybrid resin obtained by chemically bonding a polyester unit excellent in low-temperature fixability and a vinyl-based copolymer unit excellent in developability and having high compatibility with a release agent.

A mixing ratio of the polyester unit to the vinyl-based copolymer unit in mass ratio is preferably 50:50 to 90:10 because of the following reason: when the amount of the polyester unit is smaller than 50 mass %, required low-temperature fixability cannot be obtained, while, when the amount of the polyester unit is larger than 90 mass %, storage stability is apt to deteriorate and it becomes difficult to control the dispersed state of the wax.

Any of the binder resins as described above may be used alone as a binder resin. However, it is preferable to use a mixture of two or more binder resins having different molecular weights (high-molecular weight resin (high-molecular weight component) and low-molecular weight resin (low-molecular weight component)). Here, the above low-molecular weight resin means a weight average molecular weight Mw of the absolute molecular weights of a THF-soluble matter in the GPC-RALLS-viscometer analysis is $5.00\times10^3$ to $3.00\times10^5$. The above high-molecular weight resin means a weight average molecular weight Mw of the absolute molecular weights is $5.00\times10^5$ to $3.00\times10^5$. Further, in both cases, for obtaining an effect of the present invention, it is preferable that a long-chain alkyl monomer be bound to the end of the branched high-molecular weight resin. In particular, it is particularly preferable to bind a linear carboxylic acid or linear alcohol having 10 to 30 carbon atoms (more preferably 15 to 25 carbon atoms) to the end of the branched polyester resin. Specifically, examples of the liner carboxylic acid include: saturated fatty acids such as palmitic acid, stearic acid, and arachidic acid; and unsaturated fatty acids such as oleic acid, linolic acid, and linolenic acid. Examples of linear alcohols include: saturated alcohols such an octadecyl alcohol and behenyl alcohol; and unsaturated alcohols such as stearyl alcohol and oleyl alcohol. Such a liner alkyl chain is added to the branched end, thereby further improving releasability. Accordingly, the addition of these long-chain alkyl monomers is preferably carried out in the last step of condensation polymerization after preparing a branched high-molecular weight resin. In this way, these long-chain alkyl monomers can be bound to the molecular terminals and desired effects can be easily obtained. Further, a large amount of the liner chain monomer can be contained more in amount than the low-molecular weight resin by binding the long-chain alkyl monomer to the end of the branched high-molecular weight resin. Thus, the releasability, which is an effect of the present invention, can be easily obtained.

The ratio of a THF-soluble matter having an intrinsic viscosity of $5.0\times10^{-2}$ dl/g or less to the total amount of a THF-soluble matter in the GPC-RALLS-viscometer analysis, when the high-molecular weight resin is dissolved in a tetrahydrofuran (THF) solvent at 25° C. for 24 hours, is preferably 0.1 mass % to 20.0 mass %, more preferably 1.0 mass % to 10.0 mass %, and particularly preferable 1.0 mass % to 5.0 mass %. In addition, the ratio of a THF-soluble matter having an intrinsic viscosity of $1.5\times10^{-1}$ dl/g or more to the total amount of a THF-soluble matter in the GPC-RALLS-viscometer analysis, when the high-molecular weight resin is dissolved in a tetrahydrofuran (THF) solvent at 25° C. for 24 hours, is preferably 20.0 mass % to 70.0 mass %, more preferably 30.0 mass % to 65.0 mass %, and particularly preferably 30.0 mass % to 60.0 mass %. When the ratio of one having an intrinsic viscosity of $5.0\times10^{-2}$ dl/g or less is less than 0.1 mass %, the ability of mixing with a low-molecular weight resin is deteriorated and an image defect tends to occur due to the generation of a cured free resin component. On the other hand, when it is larger than 20.0 mass %, the releasability may be deteriorated. In addition, when the ratio of one having an intrinsic viscosity of $1.5\times10^{-1}$ dl/g or more is less than 20.0 mass %, the releasability may be deteriorated. When it is larger than 70.0 mass %, the fixability may be deteriorated.

An intrinsic viscosity of a THF-soluble matter having an absolute molecular weight of $1.5\times10^4$ in the GPC-RALLS-viscometer analysis, when the high-molecular weight resin is dissolved in a tetrahydrofuran (THF) solvent at 25° C. for 24 hours, is preferably $5.0\times10^{-3}$ dl/g to $1.0\times10^{-1}$ dl/g, more preferably $5.0\times10^{-3}$ dl/g to $8.0\times10^{-2}$ dl/g, still more preferably $5.0\times10^{-3}$ dl/g to $6.0\times10^{-2}$ dl/g, and particularly preferably $5.0\times10^{-3}$ dl/g to $5.0\times10^{-2}$ dl/g, and an intrinsic viscosity of a THF-soluble matter having an absolute molecular weight of $1.0\times10^5$ in the GPC-RALLS-viscometer analysis, when the high-molecular weight resin is dissolved in a tetrahydrofuran (THF) solvent at 25° C. for 24 hours, is preferably $2.0\times10^{11}$ to $4.0\times10^{-1}$ dl/g, more preferably $2.0\times10^{-1}$ to $3.5\times10^{-1}$ dl/g, and particularly preferably $2.5\times10^{-1}$ to $3.5\times10^{-1}$ dl/g. When the intrinsic viscosity at the above absolute molecular weight of $1.5\times10^4$ is less than $5.0\times10^{-3}$ dl/g, the storage stability may be deteriorated. When it is larger than $1.0\times10^{-1}$ dl/g, the ability of mixing with a low-molecular weight resin may be deteriorated. Further, when the intrinsic viscosity at the absolute molecular weight of $1.0\times10^5$ is less than $2.0\times10^{-1}$ dl/g, the releasability may be deteriorated. When it is larger than $4.0\times10^{-1}$ dl/g, the fixability may be deteriorated.

Further, a weight average molecular weight Mw of the absolute molecular weights of a THF-soluble matter in the GPC-RALLS-viscometer analysis, when the high-molecular weight resin is dissolved in a tetrahydrofuran (THF) solvent at 25° C. for 24 hours, is preferably $5.00\times10^5$ to $3.00\times10^6$, more preferably $6.00\times10^5$ to $2.00\times10^6$, and particularly preferably $7.00\times10^5$ to $1.50\times10^6$. When the above weight average molecular weight Mw of the absolute molecular weight is smaller than $5.00\times10^5$, the offset resistance may be deteriorated. When it is larger than $3.00\times10^6$, the fixability may be declined.

Further, Mw/Mn, which represents a molecular weight distribution of the absolute molecular weights of a THF-soluble matter in the GPC-RALLS-viscometer analysis, when the high-molecular weight resin is dissolved in a tetrahydrofuran (THF) solvent at 25° C. for 24 hours, is preferably 20.0 to 60.0, more preferably 30.0 to 50.0, and particularly preferably 30.0 to 45.0 from a standpoint of the compatibility of fixability with the twisted-offset resistance.

Further, the inertial square radius Rg of a THF-soluble matter in the GPC-RALLS-viscometer analysis, when high-molecular weight resin is dissolved in a tetrahydrofuran (THF) solvent at 25° C. for 24 hours, is preferably 10.0 nm to 20.0 nm, more preferably 10.0 nm to 18.0 nm, and particularly preferably 12.0 nm to 18.0 nm. When the above inertial square radius Rg is less than 10.0 nm, the extent of branching becomes too large, and the fixability may be deteriorated. In contrast, when it is larger than 20.0 nm, the extent of branching becomes too small, and the amount of a long-chain monomer bonded is decreased, thereby causing deterioration of the releasability in some cases.

A glass-transition temperature (Tg) of the above-mentioned high-molecular weight resin is preferably 40.0 to 70.0° C., more preferably 45.0 to 65.0° C., and still more preferably 50.0 to 60.0° C. When Tg is lower than 40.0° C., blocking resistance is apt to deteriorate. When Tg exceeds 70.0° C., fixability is apt to deteriorate.

In addition, a softening point (Tm) of the high-molecular weight resin is preferably 100.0° C. to 150.0° C., more preferably 110.0° C. to 130.0° C.

The ratio of a THF-soluble matter having an intrinsic viscosity of $5.0\times10^{-2}$ dl/g or less to the total amount of a THF-soluble matter, when the low-molecular weight resin is dissolved in a tetrahydrofuran (THF) solvent at 25° C. for 24 hours, is preferably 10.0 mass % to 50.0 mass %, more preferably 20.0 mass % to 40.0 mass %. In addition, the ratio of a THF-soluble matter having an intrinsic viscosity of $1.5\times10^{-1}$ dl/g or more to the total amount of a THF-soluble matter, when the low-molecular weight resin is dissolved in a tetrahydrofuran (THF) solvent at 25° C. for 24 hours, is preferably less than 10.0 mass %, more preferably less than 5.0 mass %. When the ratio of one having an intrinsic viscosity of $5.0\times10^{-2}$ dl/g or less is less than 10.0 mass %, the fixability is apt to deteriorate. On the other hand, when it is larger than 50.0 mass %, the releasability may be deteriorated. In addition, when the ratio of one having an intrinsic viscosity of $1.5\times10^{-1}$ dl/g or more is 10.0 mass % or more, the fixability may be deteriorated.

An intrinsic viscosity of a THF-soluble matter with an absolute molecular weight of $1.5\times10^{4}$ in the GPC-RALLS-viscometer analysis, when the low-molecular weight resin is dissolved in a tetrahydrofuran (THF) solvent at 25° C. for 24 hours, is preferably $5.0\times10^{-2}$ dl/g or less, more preferably $2.0\times10^{-2}$ dl/g or less. Further, when the intrinsic viscosity at the absolute molecular weight of $1.5\times10^{4}$ is larger than $5.0\times10^{-2}$ dl/g, the fixability may be deteriorated.

A molecular weight Mp of the peak top of the main peak of a THF-soluble matter in the GPC-RALLS-viscometer analysis, when the low-molecular weight resin is dissolved in a tetrahydrofuran (THF) solvent at 25° C. for 24 hours, is preferably 5,000 to 20,000, more preferably 7,000 to 15,000. When the above molecular weight Mp of the peak top of the main peak is less than 5,000, storage stability may be deteriorated. When it is larger than 20,000, the fixability may be declined.

Further, a weight average molecular weight Mw of the absolute molecular weights of a THF-soluble matter in the GPC-RALLS-viscometer analysis, when the low-molecular weight resin is dissolved in a tetrahydrofuran (THF) solvent at 25° C. for 24 hours, is preferably $5.00\times10^{3}$ to $3.00\times10^{5}$, more preferably $7.00\times10^{3}$ to $1.00\times10^{5}$. When the above weight average molecular weight Mw of the absolute molecular weight is smaller than $5.00\times10^{3}$, the offset resistance may be deteriorated. When it is larger than $3.00\times10^{5}$, the fixability may be declined.

Further, the inertial square radius Rg of a THF-soluble matter in the GPC-RALLS-viscometer analysis, when low-molecular weight resin is dissolved in a tetrahydrofuran (THF) solvent at 25° C. for 24 hours, is preferably 3.0 nm to 10.0 nm, more preferably 4.0 nm to 8.0 nm. When the above inertial square radius Rg is less than 3.0 nm, the extent of branching becomes too large, and the fixability may be deteriorated. In contrast, when the above inertial square radius Rg is more than 10.0 nm, the extent of branching becomes too small, thereby causing deterioration of the releasability in some cases.

The softening point (Tm) of the above low-molecular weight resin is preferably in the range of 80.0° C. to 105.0° C., more preferably in the range of 90.0° C. to 100.0° C. in terms of a balance between the fixability and the offset resistance.

In addition, the glass transition temperature (Tg) of the above low-molecular weight resin is preferably 45.0 to 60.0° C., and more preferably 45.0 to 58.0° C. from the viewpoints of fixability and storage stability.

When those two kinds of resins are used as a mixture, a ratio between the high-molecular weight resin and the low-molecular weight resin is preferably 90:10 to 20:80 in mass ratio ([the high-molecular weight resin]:[the low-molecular weight resin]) from the viewpoints of offset property and polymer mixing property.

Hereinafter, a monomer for use in the polyester unit in the binder resin to be used in the present invention will be described. An alcohol which is dihydric or trihydric or more, and a carboxylic acid which is divalent or trivalent or more, an acid anhydride, or lower alkyl ester thereof are used as raw material monomers for the polyester unit. Here, when a branched polymer is produced, it is effective to perform partial crosslinking in a molecule of the binder resin. The use of a polyfunctional compound which is trivalent or more achieves the partial crosslinking. Therefore, in the present invention, a carboxylic acid which is trivalent or more, an acid anhydride, or lower alkyl ester thereof, and/or an alcohol which is trihydric or more is preferably incorporated as a raw material monomer.

Examples of the dihydric carboxylic acid component include: maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid; and anhydrides or lower alkyl esters of those acids. Of those, maleic acid, fumaric acid, terephthalic acid, and n-dodecenylsuccinic acid are preferably used.

Examples of the carboxylic acid which is trivalent or more, the acid anhydride thereof, or the lower alkyl ester thereof include: 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empole trimer acid; and acid anhydrides thereof or lower alkyl esters thereof. Of those, in particular, 1,2,4-benzenetricarboxylic acid, that is, trimellitic acid or derivatives thereof are preferably used because those are inexpensive and their reactions can be easily controlled.

In the present invention, one of the dihydric carboxylic acid, the carboxylic acid which is trivalent or more, and the like may be used alone or two or more kinds thereof may be used in combination.

Examples of the dihydric alcohol component include: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A. Of those, alkylene oxide adducts of bisphenol A, ethylene glycol, 1,2-propylene glycol, 1,3-propylene glycol, and neopentyl glycol are preferably used. In particular, ethylene glycol is preferable because it enhances a sharp melt property of a resin.

Examples of the alcohol component having three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Of those, glycerol, trimethylolpropane, and pentaerythritol are preferably used.

In the present invention, one of the dihydric alcohol and alcohol having three or more hydroxyl groups may be used alone or two or more kinds thereof may be used in combination.

Examples of the catalyst include a catalyst generally used for polyesteration, for example: metals such as tin, titanium, antimony, manganese, nickel, zinc, lead, iron, magnesium, calcium, and germanium; and compounds containing those metals such as dibutyl tinoxide, orthodibutyltitanate, tetrabutyl titanate, zinc acetate, lead acetate, cobalt acetate, sodium acetate, and antimony trioxide.

Examples of the vinyl-based monomer to be used for producing a vinyl-based copolymer unit to be used for the above-mentioned binder resin include the following styrene-based monomers and acrylic acid-based monomers.

Examples of the styrene-based monomer include: styrene and derivatives thereof such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

Examples of the acrylic acid-based monomer include: acrylic acids and acrylic esters such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acids and esters thereof such as methacrylic acid, methyl methacrylate, ethyl methacrylate, propyl methacrylate, n-butylmethacrylate, isobutylmethacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and acrylic acid or methacrylic acid derivatives such as acrylonitrile, methacrylonitrile, and acrylamide.

Further, examples of the monomer of a vinyl-based copolymer unit include: acrylic ester or methacrylic ester such as 2-hydroxylethyl acrylate, 2-hydroxylethyl methacrylate, and 2-hydroxylpropyl methacrylate; and monomers each having a hydroxyl group such as 4-(1-hydroxy-1-methylbutyl) styrene and 4-(1-hydroxy-1-methylhexyl) styrene.

In the vinyl-based copolymer unit, if required, it is possible to use in combination with various monomers each capable of vinyl polymerization. Examples of such monomers include: ethylene-based unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and further, unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated basic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated basic acid esters such as dimethyl maleate and dimethyl fumarate; acid anhydrides of α,β-unsaturated acids such as acrylic acid, methacrylic acid, crotonic acid, and cinnamic acid; anhydrides of the above-mentioned α,β-unsaturated acids and lower aliphatic acids; and monomers each having a carboxyl group such as alkenylmalonic acid, alkenylglutaric acid, and alkenyladipic acid, and acid anhydrides thereof and monoesters thereof.

In addition, the vinyl-based copolymer unit may be a polymer crosslinked by a crosslinkable monomer as exemplified below as required. Examples of the crosslinkable monomer include: aromatic divinyl compounds; diacrylate compounds connected by alkyl chains; diacrylate compounds connected by alkyl chains each containing an ether bond; diacrylate compounds connected by chains each containing an aromatic group and an ether bond; polyester type diacrylates; and polyfunctional crosslinking agents.

Examples of the aromatic divinyl compound include divinyl benzene and divinyl naphthalene.

Examples of the above-mentioned diacrylate compounds connected by alkyl chains include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the acrylate of the above-mentioned compounds to methacrylate.

Examples of the above-mentioned diacrylate compounds connected by the alkyl chains each containing ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the acrylate of the above-mentioned compounds to methacrylate.

Examples of the above-mentioned diacrylate compounds connected by chains each containing aromatic group and ether bond include: polyoxyethylene(2)-2,2-bis(4-hydroxyphenyl)propane diacrylate and polyoxyethylene(4)-2,2-bis(4-hydroxyphenyl)propane diacrylate; and those obtained by changing the acrylate of the above-mentioned compounds to methacrylate. An example of the polyester type diacrylates includes MANDA, trade name, manufactured by Nippon Kayaku Co., Ltd.

Example of the above-mentioned polyfunctional crosslinking agents include: pentaerythritol triacrylate, trimethylolethane triacrylate, trimethylolpropane triacrylate, tetramethylolmethane tetraacrylate, and oligoester acrylate; those obtained by changing the acrylate of the above-mentioned compounds to methacrylate; triallyl cyanurate; and triallyl trimellitate.

Each of those crosslinkable monomers can be used in an amount of preferably 0.01 mass % to 10 mass %, more preferably 0.03 mass % to 5 mass % with respect to the entire amount of the monomer components. In addition, examples of a monomer to be suitably used in terms of fixability and offset resistance out of those crosslinkable monomers include aromatic divinyl compounds (in particular, divinylbenzene) and diacrylate compounds connected by chains each containing an aromatic group and an ether bond.

The vinyl-based copolymer unit may be a resin produced by using any one of polymerization initiators. Each of those initiators is preferably used in an amount of 0.05 to 10 parts by mass with respect to 100 parts by mass of the monomer in terms of efficiency.

Examples of such polymerization initiators include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketoneperoxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutylhydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

A hybrid resin to be more preferably used as the above-mentioned binder resin is a resin in which the polyester unit and the vinyl-based copolymer unit are chemically bound to each other directly or indirectly.

Therefore, polymerization is performed by using a compound capable of reacting with the monomers of both resins (hereinafter referred to as "bireactive compound"). Examples of the bireactive compound include compounds such as fumaric acid, acrylic acid, methacrylic acid, citraconic acid, maleic acid, and dimethyl fumarate in the monomers of the condensation polymerization-based resin and the monomers of the addition polymerization-based resin described above. Of those, fumaric acid, acrylic acid, and methacrylic acid are preferably used.

The amount of the bireactive compound to be used is preferably 0.1 to 20 mass %, more preferably 0.2 to 10 mass % with respect to all raw material monomers.

The hybrid resin can be obtained by causing the raw material monomers for the polyester unit and the raw material monomers for the vinyl-based copolymer unit to react with each other simultaneously or sequentially. A preferable method in the present invention involves: subjecting a vinyl-based copolymer monomer or an unsaturated polyester resin to an addition polymerization reaction; and subjecting the raw material monomers for the polyester unit to a condensation polymerization reaction after the addition polymerization reaction from the viewpoints of enhancing molecular weight control.

A preferable embodiment of the toner of the present invention includes wax having 30 to 80 carbon atoms for the purpose of increasing a low-temperature fixability in a high-speed developing system. In addition, in a preferable embodiment, wax is added during the production of a binder resin, where the following expression (1) is established with regard to the number of carbon atoms Cw in the wax and the number of carbon atoms Cr in a linear carboxylic acid or linear alcohol:

$$1.1 \leqq Cw/Cr \leqq 8.0 \qquad \text{Expression (1)}$$

The ratio defines a dispersion state between the liner monomer and the wax. By adjusting the ratio within the above range, in the high-speed developing system, the releasing effect of the present invention can be easily obtained while retaining excellent low-temperature fixability. When the ratio is less than 1.1, the molecular chain length of the liner monomer is too close to the molecular chain length of the wax, so the compatibility of wax to the liner monomer tends to occur. As a result, a sufficient releasing effect of the linear monomer cannot be obtained, thereby resulting in poor adhesion of ejected sheets in some cases. In contrast, when it exceeds 8.0, the molecular chain length of wax becomes too long, thereby being entangled with the linear monomer. As a result, the dispersibility of wax may be degraded, the distribution of electrification may become uneven, and the developability may be degraded.

The above-mentioned wax has preferably a melting point specified by the temperature at which an endothermic peak is present upon temperature increase measured by using a differential scanning calorimeter (DSC) of 60.0 to 120.0° C., and preferably 60.0 to 100.0° C. When the melting point is lower than 60.0° C., the viscosity of the toner reduces, a releasing effect reduces, and the contamination of a developing member or of a cleaning member due to duration may easily occur. On the other hand, when the melting point is higher than 120.0° C., required low-temperature fixability may be hardly obtained.

The amount of the above-mentioned wax to be added is preferably 1 to 20 parts by mass with respect to 100 parts by mass of the binder resin. When the amount is less than 1 part by mass, a desired releasing effect may not be sufficiently obtained. When the amount exceeds 20 parts by mass, the dispersibility of the wax in the toner may be decreased, and the adhesion of the toner to a photosensitive member, the contamination of the surface of a developing member or of a cleaning member, or the like may occur, with the result that a problem such as the deterioration of a toner image is apt to occur.

Examples of the wax include: aliphatic hydrocarbon-based wax such as low-molecular weight polyethylene, low-molecular weight polypropylene, microcrystalline wax, and paraffin wax; oxides of aliphatic hydrocarbon-based wax such as polyethylene oxide wax; block copolymers of the aliphatic hydrocarbon-based wax; wax mainly formed of fatty acid esters such as carnauba wax, sasol wax, and montanic acid ester wax; and partially or wholly deacidified fatty acid esters such as deacidified carnauba wax.

Examples of the wax to be particularly preferably used in the present invention include aliphatic hydrocarbon-based wax. The examples of such aliphatic hydrocarbon-based wax include: a low-molecular weight alkylene polymer obtained by subjecting an alkylene to radical polymerization under high pressure or by polymerizing an alkylene under reduced pressure by using a Ziegler catalyst; an alkylene polymer obtained by thermal decomposition of a high-molecular weight alkylene polymer; synthetic hydrocarbon wax obtained from a residue on distillation of a hydrocarbon obtained by means of an Arge method from a synthetic gas containing carbon monoxide and hydrogen, and synthetic hydrocarbon wax obtained by hydrogenation thereof; and those obtained by fractionating those aliphatic hydrocarbon-based wax by means of a press sweating method, a solvent method, or vacuum distillation or according to a fractional crystallization mode.

Examples of a hydrocarbon as a matrix of the above aliphatic hydrocarbon-based wax include: those obtained by a reaction of carbon monoxide with hydrogen in the presence of a metal oxide catalyst (mostly multi-component catalyst having two ore more components) (for example, hydrocarbon compounds prepared by the synthol method and the hydrocol method (fluid catalyst beds are used)); and hydrocarbons obtained by polymerization of alkylene such as ethylene with a Ziegler catalyst. Among these hydrocarbons, a small and linear hydrocarbon having a small number of branches is preferable. In particular, a hydrocarbon prepared by a method which does not include alkylene polymerization is preferable also in terms of its molecular weight distribution. Further, it may be combined with wax having more than 80 carbon atoms. In this case, however, for obtaining an effect of the present invention, the wax may be preferably added at the time of melt-kneading in the toner production.

Specific examples of the wax include: Biscol (registered trademark) 330-P, 550-P, 660-P, and TS-200 (Sanyo Chemical Industries, Ltd.); HI-WAX 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD); Unilin (registered trademark) 350, 425, 550, and 700, Unisid (registered trademark) 350, 425, 550, and 700 (TOYO-PETROLITE); and a haze wax, a beeswax, a rice wax, a candelilla wax, and a carnauba wax (available from CERARICA NODA Co., Ltd.).

The toner of the present invention may be a magnetic toner or a non-magnetic toner, and the toner of the present invention is preferably a magnetic toner in terms of, for example, durability in a high-speed machine.

Examples of the magnetic material to be used in the present invention include: magnetic iron oxides containing iron oxides such as magnetite, maghemite, and ferrite and other metal oxides; metals such as Fe, Co, and Ni, or alloys thereof with metals such as Al, Co, Pb, Mg, Ni, Sn, Zn, Sb, Be, Bf, Cd, Ca, Mn, Se, Ti, W, and V; and mixtures thereof. Conventionally, triiron tetraoxide ($Fe_3O_4$), γ-iron sesquioxide ($\gamma$-$Fe_2O_3$), zinc iron oxide ($ZnFe_2O_4$), yttrium iron oxide ($Y_3Fe_5O_{12}$), cadmium iron oxide ($Cd_3Fe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and the like are known. Particularly preferable magnetic material is fine powder of triion tetraoxide or γ-iron sesquioxide. Further, each of the magnetic materials mentioned above can be selected and used alone, or two or more kinds thereof can be selected and used in combination.

Each of those magnetic materials preferably has magnetic properties in an applied magnetic field of 796 kA/m including: a magnetic resistance of 1.6 to 12.0 kA/m; a saturation magnetization of 50 to 200 $Am^2/kg$ (more preferably 50 to 100 $Am^2/kg$); and a residual magnetization of 2 to 20 $Am^2/kg$. The magnetic properties of a magnetic material in an external magnetic field of 796 kA/m at 25° C. can be measured by using an oscillation sample type magnetometer such as a VSM P-1-10 (manufactured by Toei Industry Co., Ltd.).

The amount of the magnetic material to be added is preferably 10 to 200 parts by mass with respect to 100 parts by mass of the binder resin.

In addition, carbon black or at least one kind of the other conventionally known various pigments and dyes can be used as the colorant to be used in the present invention.

Examples of the dye include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Example of the pigment include Chrome Yellow, Cadmium Yellow, Mineral Fast Yellow, Navel Yellow, Naphthol Yellow S, Hansa Yellow G, Permanent Yellow NCG, Tartrazine Lake, Chrome Orange, Molybdenum Orange, Permanent Orange GTR, Pyrazolone Orange, Benzidine Orange G, Cadmium Red, Permanent Red 4R, Watchung Red Calcium Salt, Eosine Lake, Brilliant Carmine 3B, Manganese Purple, Fast Violet B, Methyl Violet Lake, Prussian Blue, Cobalt Blue, Alkali Blue Lake, Victoria Blue Lake, Phthalocyanine Blue, Fast Sky Blue, Indanthrene Blue BC, Chrome Green, Chrome Oxide, Pigment Green B, Malachite Green Lake, and Final Yellow Green G.

When the toner of the present invention is used for full color image-forming toner, the following colorants can be used. Examples of coloring pigments for magenta include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. Pigment Violet 19; and C.I. Vat Red 1, 2, 10, 13, 15, 23, 29, and 35.

Each of the magenta pigments may be used alone. However, it is more preferable to combine the dye and the pigment to improve definition of an image, from the viewpoint of image quality of a full color image. Examples of the dye for magenta include: oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of the coloring pigment for cyan include: C.I. Pigment Blue 2, 3, 15, 16, and 17; C.I. Vat Blue 6; C.I. Acid Blue 45; or a copper phthalocyanine pigment in which a phthalocyanine skeleton having the following structure is substituted by 1 to 5 phthalimidemethyl groups.

[Chem 1]

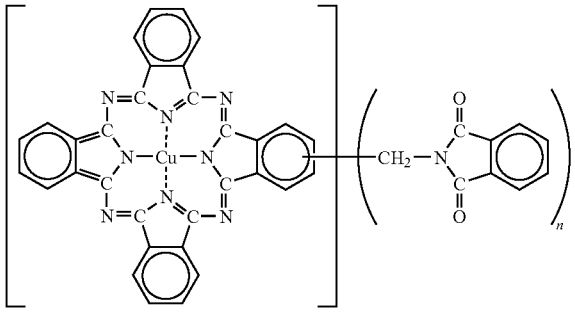

$n = 1\sim5$

Examples of the coloring pigment for yellow include: C.I. Pigment Yellow 1, 2, 3, 4, 5, 6, 7, 10, 11, 12, 13, 14, 15, 16, 17, 23, 35, 73, and 83; and C.I. Vat yellow 1, 3, and 20.

The content of the above colorant is preferably 0.1 to 60 parts by mass, or more preferably 0.5 to 50 parts by mass with respect to 100 parts by mass of the content of the binder resin.

The toner of the present invention employs a charge control agent for stabilizing the chargeability of the toner. It is preferable to employ a charge control resin with an intrinsic viscosity of $1.0\times10^{-1}$ dl/g to $3.0\times10^{-1}$ dl/g when a THF-soluble matter has an absolute molecular weight of $1.5\times10^{4}$ in the GPC-RALLS-viscometer analysis when dissolved in a tetrahydrofuran (THF) solvent at 25° C. for 24 hours. This is because the use of the charge control resin having the appropriate viscosity allows a toner to be subjected to shear upon toner melt-mixing, while improving the fine-dispersibilities of the respective raw materials such as a low-viscosity resin and wax. As a result, even in a high-speed developing system, the toner can be provided with an excellent developability.

When the above intrinsic viscosity is less than $1.0\times10^{-1}$ dl/g at absolute molecular weight of $1.5\times10^{4}$, a sufficient shearing force may not be exerted upon the melt-mixing of toner and thus the fine-dispersibilities of the respective raw materials in the toner may deteriorate, thereby developability may decrease. On the other hand, when the above intrinsic viscosity at absolute molecular weight of $1.5\times10^{4}$ is larger than $3.0\times10^{-1}$ dl/g, it may not mix with other raw materials and may become a free resin component, thereby facilitating the generation of an image defect such as an uneven image in some cases.

Further, it is preferable that the weight average molecular weight of the above charge control resin defined using GPC is 2,500 to 100,000, more preferably 5,000 to 50,000, particularly preferably 20,000 to 40,000. When the above weight average molecular weight is less than 2,500, the amount of electric charges may decrease in high-humidity environment and subsequently the offset resistance may be deteriorated. When the weight average molecular weight is larger than 100,000, the compatibility with resin may deteriorate and then the toner may become smaller in particle size, thereby may become impossible to obtain stable chargeability with environmental fluctuation and with time.

The glass-transition temperature of the above charge control resin is preferably 40 to 90° C., more preferably 50 to 80° C., particularly preferably 60 to 80° C. When the above glass-transition temperature is less than 40° C., the storage stability of toner may be decreased. When it exceeds 90° C., the low-temperature fixability tends to be deteriorated.

Any of charge control agents known in the art may be used in combination with the above charge control resin.

The chargeability of toner of the present invention may be either positive or negative. Preferably, however, it may be a negatively chargeable toner because a polyester resin itself, a binder resin, is highly negatively chargeable. The charge control agent may differ depending on its type, physical properties of other structural materials of toner particles, and the like. In general, it is more preferable that the toner includes the charge control agent in amount of 0.1 to 10 parts by mass, more preferably 0.1 to 5 parts by mass per 100 parts by mass of the binder resin. Examples of such a charge control agent, which have been known in the art, include those capable of controlling the toner to be negatively chargeable and those capable of controlling the toner to be positively chargeable. One or two or more different charge control agents can be used depending on the types and the usages of toners.

For example, an organometallic complex or a chelate compound is an effective charge control agent for controlling toner to be negatively chargeable. Examples of such charge control agent for controlling toner to be negatively chargeable include: monoazo metal complexes; acetylacetone metal complexes; and metal complexes or metal salts of aromatic hydroxycarboxylic acids or aromatic dicarboxylic acids. The examples of such charge control agent for controlling toner to be negatively chargeable further include: aromatic monocarboxylic and polycarboxylic acids, and metal salts and anhydrates of the acids; esters; and phenol derivatives such as bisphenol.

Examples of a charge control agent for controlling toner to be positively chargeable include: nigrosin and denatured products of nigrosin with aliphatic acid metal salts and the like; quaternary ammonium salts such as tributylbenzyl ammonium- 1-hydroxy-4-naphtolsulfonate and tetrabutyl ammonium tetrafluoroborate, and analogs of the salts, which are onium salts such as phosphonium salts and lake pigments of the salts; triphenyl methane dyes and lake pigments of the dyes (lake agents include phosphotungstic acid, phosphomolybdic acid, phosphotungsten molybdic acid, tannic acid, lauric acid, gallic acid, ferricyanic acid, and ferrocyanide); metal salts of higher aliphatic acids; diorganotin oxides such as dibutyltin oxide, dioctyltin oxide, and dicyclohexyltin oxide; and diorganotin borates such as dibutyltin borate, dioctyltin borate, and dicyclohexyltin borate. In the present invention, one kind of them may be used alone, or two or more kinds of them may be used in combination. Of those, a charge control agent for controlling toner to be positively chargeable made of a nigrosin-based compound, a quaternary ammonium salt, or the like is particularly preferably used.

Specific examples of the charge control agent that can be used include: Spilon Black TRH, T-77, and T-95 (Hodogaya Chemical Co., Ltd.); and BONTRON (registered trademark) S-34, S-44, S-54, E-84, E-88, and E-89 (Orient Chemical Industries, LTD.). Preferable examples of the charge control agent for positive charging include: TP-302 and TP-415 (Hodogaya Chemical Co., Ltd.); BONTRON (registered trademark) N-01, N-04, N-07, and P-51 (Orient Chemical Industries, LTD.); and Copy Blue PR (Clariant).

An inorganic fine powder may be used as a fluidity improver in the toner of the present invention. Any improver can be used as the fluidity improver as long as the improver can improve fluidity as compared to that before external addition to toner particles. Examples of such fluidity improver include: fine powdered silica such as silica obtained through a wet process or silica obtained through a dry process; and treated silica obtained by treating the surface of any one of the above-mentioned silicas with a silane coupling agent, a titanium coupling agent, silicone oil, or the like. A preferable fluidity improver is a fine powder produced through the vapor phase oxidation of a silicon halide compound, the fine powder being called dry process silica or fumed silica. That is, the dry process silica or fumed silica is produced by means of a conventionally known technology. For example, the production utilizes a thermal decomposition oxidation reaction in oxygen and hydrogen of a silicon tetrachloride gas, and a basic reaction formula for the reaction is represented by the following formula:

$$SiCl_4+2H_2+O_2 \rightarrow SiO_2+4HCl$$

A composite fine powder of silica and any other metal oxide can also be obtained by using a silicon halide compound with any other metal halide compound such as aluminum chloride or titanium chloride in the production step, and silica comprehends the composite fine powder as well. A silica fine powder having an average primary particle size in the range of preferably 0.001 to 2 μm, or particularly preferably 0.002 to 0.2 μm is desirably used.

Examples of a commercially available silica fine powder produced through the vapor phase oxidation of a silicon halide compound include those commercially available under the following trade names.

AEROSiL 130, AEROSiL 200, AEROSiL 300, AEROSiL 380, AEROSiL TT600, AEROSiL MOX170, AEROSiL MOX80, AEROSiL COK84 (NIPPON AEROSIL Co., Ltd.); Ca—O—SiL M-5, Ca—O—SiL MS-7, Ca—O—SiL MS-75, Ca—O—SiL HS-5, Ca—O—SiL EH-5 (CABOT Co.); Wacker HDK N 20, Wacker HDK V15, Wacker HDK N20E, Wacker HDK T30, Wacker HDK T40 (WACKER-CHEMIE GNBH); D-CFine Silica (DOW CORNING Co.); and Fransol (Francil).

Further, a treated silica fine powder obtained by subjecting the silica fine powder produced through the vapor phase oxidation of a silicon halide compound to a hydrophobic treatment is preferably used. The treated silica fine powder is particularly preferably obtained by treating the silica fine powder in such a manner that the degree of hydrophobicity titrated by a methanol titration test shows a value in the range of 30 to 80.

Hydrophobicity is imparted by chemically treating the silica fine powder with, for example, an organic silicon compound that reacts with, or physically adsorbs to, the silica fine powder. A preferable method involves treating the silica fine powder produced through the vapor phase oxidation of a silicon halide compound with an organic silicon compound. Examples of such organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si within a unit located in each of terminals. One of those compounds is used alone or mixture of two or more thereof.

The inorganic fine powder may be treated with silicone oil, or may be treated together with the above-mentioned hydrophobic treatment. Silicone oil having a viscosity of 30 to 1,000 $mm^2/s$ at 25° C. is preferably used. Examples of particularly preferable silicone oil include dimethyl silicone oil, methylphenyl silicone oil, α-methylstyrene-denatured silicone oil, chlorophenyl silicone oil, and fluorine-denatured silicone oil.

Examples of a method for treatment with silicone oil that can be employed include: a method involving directly mixing a silica fine powder treated with a silane coupling agent and silicone oil by using a mixer such as a Henschel mixer; a method involving spraying a silica fine powder serving as a base with silicone oil; and a method involving dissolving or dispersing silicone oil into an appropriate solvent, and adding and mixing a silica fine powder to and with the solution to remove the solvent. After silica has been treated with silicone oil, the temperature of the silica treated with silicone oil is preferably heated to 200° C. or higher (more preferably 250° C. or higher) in an inert gas so that the coat on the surface of silica is stabilized.

One of nitrogen atom-containing silane coupling agents such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine can be used alone or in combination. As a preferable silane coupling agent, there is given hexamethyldisilazane (HMDS).

In the present invention, one obtained by means of a method involving treating silica with a coupling agent in advance and treating the resultant with silicone oil, or a method involving treating silica with a coupling agent and silicone oil simultaneously is preferable.

The fluidity improver having a specific surface area according to nitrogen adsorption measured by means of a BET method of 30 $m^2/g$ or more, or preferably 50 $m^2/g$ or more provides good results. The fluidity improver is desirably used in an amount of 0.01 to 8 parts by mass, or preferably 0.1 to 4 parts by mass with respect to 100 parts by mass of the toner particles.

In addition, any external additive other than the charge control agent and the fluidity improver may be added to the toner of the present invention as required. Examples of such external additive include resin fine particles and inorganic fine particles serving as charging adjuvants, conductivity imparting agents, fluidity imparting agents, caking inhibitors, wax, lubricants, and abrasives. For example, lubricants such as Teflon (registered trademark), zinc stearate, and polyvinylidene fluoride can be exemplified, and, of those, polyvinylidene fluoride is preferable. Alternatively, abrasives such as cerium oxide, silicon carbide, and strontium titanate can be exemplified, and, of those, strontium titanate is preferable.

Alternatively, fluidity imparting agents such as titanium oxide and aluminum oxide can be exemplified, and, of those, a fluidity imparting agent which is hydrophobic is particularly preferable. Caking inhibitors, or conductivity imparting agents such as carbon black, zinc oxide, antimony oxide, and tin oxide may also be used. In addition, fine particles opposite in polarity can be used in a small amount as a developability improver.

The amount of resin fine particles, an inorganic fine powder, a hydrophobic inorganic fine powder, or the like to be mixed with the toner is preferably 0.1 to 5 parts by mass with respect to 100 parts by mass of the toner.

The toner of the present invention preferably has a weight average particle size of 3 to 9 μm in terms of image density, resolution, and the like.

The toner of the present invention can be obtained by: sufficiently mixing a binder resin, a colorant, any other additive, and the like by using a mixer such as a Henschel mixer or a ball mill; melting and kneading the mixture by using a heat kneader such as a heat roll, a kneader, or an extruder; cooling and solidifying the kneaded product; grinding and classifying the solidified product; and sufficiently mixing a desired additive with the resultant by using a mixer such as a Henschel mixer as required.

Examples of the mixer include: a Henschel mixer (manufactured by Mitsui Mining Co., Ltd.); a Super mixer (manufactured by Kawata); a Ribocorn (manufactured by Okawara Corporation); a Nauta mixer, a Turbulizer, and a Cyclomix (manufactured by Hosokawa Micron Corporation); a Spiral pin mixer (manufactured by Pacific Machinery & Engineering Co., Ltd.); and a Lodige mixer (manufactured by Matsubo Corporation). Examples of the kneader include: a KRC kneader (manufactured by Kurimoto, Ltd.); a Buss co-kneader (manufactured by Buss); a TEM extruder (manufactured by Toshiba Machine Co., Ltd.); a TEX biaxial kneader (manufactured by Japan Steel Works Ltd.); a PCM kneader (manufactured by Ikegai); a Three-roll mill, a Mixing roll mill, and a Kneader (manufactured by Inoue Manufacturing Co., Ltd.); a Kneadex (manufactured by Mitsui Mining Co., Ltd.); an MS pressure kneader and a Kneader-ruder (manufactured by Moriyama Manufacturing Co., Ltd.); and a Banbury mixer (manufactured by Kobe Steels, Ltd.). Examples of the grinder include: a Counter jet mill, a Micronjet, and an Inomizer (manufactured by Hosokawa Micron Corporation); an IDS mill and a PJM jet grinder (manufactured by Nippon Pneumatic Mfg, Co., Ltd.); a Cross jet mill (manufactured by Kurimoto, Ltd.); an Urumax (manufactured by Nisso Engineering Co., Ltd.); an SK Jet Mill (manufactured by Seishin Enterprise Co., Ltd.); a Kryptron system (manufactured by Kawasaki Heavy Industries, Ltd.); a Turbo mill (manufactured by Turbo Kogyo Co., Ltd.); and a Super rotor (manufactured by Nisshin Engineering Inc.). Examples of the classifier include: a Classiel, a Micron classifier, and a Spedic classifier (manufactured by Seishin Enterprise Co., Ltd.); a Turbo classifier (manufactured by Nisshin Engineering Inc.); a Micron separator, a Turboplex (ATP), and a TSP separator (manufactured by Hosokawa Micron Corporation); an Elbow jet (manufactured by Nittetsu Mining Co., Ltd.); a Dispersion separator (manufactured by Nippon Pneumatic Mfg, Co., Ltd.); and a YM microcut (manufactured by Yasukawa Shoji). Examples of the sieving device, i.e., classifier, to be used for sieving coarse particles and the like include: an Ultrasonic (manufactured by Koei Sangyo Co., Ltd.); a Resonasieve and a Gyrosifter (manufactured by Tokuju Corporation); a Vibrasonic system (manufactured by Dalton Corporation); a Soniclean (manufactured by Shintokogio Ltd.); a Turbo screener (manufactured by Turbo Kogyo Co., Ltd.); a Microsifter (manufactured by Makino mfg Co., Ltd.); and a circular vibrating screen.

Hereinafter, methods for determining physical properties of the present invention will be described.

(1) GPC-RALLS-Viscometer Analysis (i) Pretreatment

A sample (0.1 g of toner or 0.05 g of binder resin) is placed together with 10 ml of tetrahydrofuran (THF) in a 20-ml test tube. It is then dissolved at 25° C. for 24 hours. After that, a sample-treatment filter (0.2 to 0.5 μm in pore size, Myshori-Disk H-25-2 manufactured by Tosoh Corporation, for example, can be used. In the present example, a sample for the GPC is one passed through the Myshori-Disk H-25-5 with a pore size of 0.5 μm (manufactured by Tosoh Corporation) was used) as a sample-treatment filter.

(ii) Analysis Conditions

| | |
|---|---|
| Devices: | HLC-8120GPC manufactured by TOSOH CORPORATION DAWN EOS (manufactured by Wyatt Technology Corporation) High-temperature differential pressure viscosity detector (manufactured by Viscotek) |
| Columns: | Combination of four columns KF-807, 806M, 805, and 803 (manufactured by SHOWA DENKO K.K.) in series |
| Detector 1: | Multi-angle light scattering detector Wyatt DAWN EOS |
| Detector 2: | High-temperature differential pressure viscosity detector |
| Detector 3: | Brice differential refractometer |
| Temperature: | 40° C. |
| Solvent: | THF |
| Flow rate: | 1.0 ml/min |
| Injection amount: | 400 μl |

In this measurement, a molecular weight distribution based on an absolute molecular weight, an inertial square radius, and an intrinsic viscosity are directly output. A theory for the measurement is as shown below.

[Measurement Theory]

$M_{90} = R(\theta_{90})/KC$ . . . Rayleigh equation
$M_{90}$: Molecular weight at 90°
$R(\theta_{90})$: Rayleigh ratio at a scattering angle of 90°
K: Optical constant ($= 2\pi^2 n^2/\lambda_0^4 N_A \cdot (dn/dc)^2$)
C: Solution concentration
$R_g = (1/6)^{1/2}([\eta]M_{90}/\Phi)^{1/3}$ . . . Flory Fox equation
$R_g$: Inertial radius
$\eta$: Intrinsic viscosity
$\Phi$: Shape element
Absolute molecular weight: $M = R(\theta_0)/KC$
$R(\theta_0) = R(\theta_{90})/P(\theta_{90})$
$P(\theta_{90}) = 2/X^2 \cdot (e^{-X} - (1 - X))$ $(X = 4\pi n/\lambda \cdot R_g)$ $\lambda$: Wavelength Here, a value for (dn/dc) was set to 0.089 ml/g for a hybrid resin-containing toner, 0.078 ml/g for a toner containing only a polyester resin, or 0.185 ml/g for linear polystyrene.

(2) Method of Measuring Softening Point (Tm) of Each of Resin and Toner

The term "softening point" refers to one measured by using a Koka type flow tester in conformance with JIS K 7210. A specific measurement method is shown below. While 1 $cm^3$ of a sample is heated by using a Koka type flow tester (manufactured by Shimadzu Corporation) at a rate of temperature increase of 4° C./min, a load of 980 N/m$^2$ (i.e., 10 kg/cm$^2$) is applied to the sample by using a plunger so that a nozzle having a diameter of 1 mm and a length of 1 mm is extruded. A plunger fallout amount (i.e., flow value)-temperature curve is drawn on the basis of the result of the extrusion. The height of the S-shaped curve is represented by h, and the temperature corresponding to h/2 (i.e., the temperature at which one half of a resin flows out) is defined as a softening point.

(3) Measurement of Glass-Transition Temperature (Tg) of Each of Resin and Toner and Melting Point of Wax Measuring devices: Measurement is performed in accordance with ASTM D3418-82 by using a differential scanning calorimeter (DSC), MDSC-2920 (manufactured by TA Instruments).

A measurement sample is precisely weighed by 2 to 10 mg, preferably 3 mg. The sample is placed into an aluminum pan, and measurement is performed in the measurement temperature range of 30 to 200° C. and at a rate of temperature increase of 10° C./min at room temperature and room humidity by using an empty aluminum pan as a reference. Analysis is performed by using a DSC curve in the temperature range of 30 to 200° C. obtained in a second heating process. A value obtained by the analysis using the resultant DSC curve by a middle point method is used for a glass-transition temperature (Tg). In addition, a value for the temperature at which an endothermic main peak of the resultant DSC curve is present is used as the melting point of a wax.

(4) Method of Determining Weight Average Particle Size of Toner Particles

In the present invention, the weight average particle size (D4) of toner particles is determined using COULTER COUNTER MULTISIZER II (manufactured by Coulter Co., Ltd.). For an electrolyte, primary sodium chloride is used and prepared in an aqueous solution of about 1% NaCl. The electrolyte used may be, for example, ISOTONR-II (manufactured by Coulter Scientific Japan Co., Ltd.).

As a determination method, 0.1 to 5 ml of a surfactant (preferably alkyl benzene sulfonate) is added as a dispersant to 100 to 150 ml of the above aqueous electrolyte solution and then 2 to 20 mg of a sample to be determined is added. The electrolyte in which the measurement sample is suspended is subjected to a dispersion treatment with an ultrasonic dispersing device for about 1 to 3 minutes. In the above measurement device, an aperture used is one having 100 μm and the volumes and the number of toner particles having particle sizes of 2.00 to 40.30 μm are determined for every channel as described below, thereby calculating both the toner volume distribution and the number distribution of toner particles. From the calculation results, the weight average particle size (D4) of the toner particles was obtained.

The channels used are 13 channels: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm (a median value of each channel is defined as a representative value of each channel).

(5) Amount of THF-Insoluble Matter of Resin Components in Toner (Amount of THF-Insoluble Matter)

Weighed 2 g of toner are put in a cylindrical filter paper (for example, No. 86R size of 28×10 mm, manufactured by Toyo Roshi Kaisha, Ltd.) and charged in Soxhlet extractor. 200 ml of THF are used as a solvent, and extraction is performed for 16 hours. In this time, the extraction is performed at such a reflux rate that an extraction cycle of THF is once per about 4 to 5 minutes. After the extraction, an amount of an insoluble matter in the toner is obtained by weighing the cylindrical filter paper taken from the extractor.

In a case where the toner include a THF-insoluble matter other than a resin component like a magnetic material and pigment, a mass of the toner put in the cylindrical filter paper is represented by W1 g, a mass of extracted THF-soluble resin component is represented by W2 g, and a mass of THF-insoluble matter other than the resin component included in the toner is represented by W3 g. Then, an amount of THF-insoluble matter of the resin component included in the toner is determined by the following formula.

$$\text{THF-insoluble matter (mass \%)}=[W1-(W3+W2)]/(W1-W3)\times 100$$

EXAMPLES

Hereinafter, the present invention will be described in detail with reference to examples. However, the present invention will be not limited to these specific examples. In addition, in the resin, a portion of a polyester unit is represented by PES part; a portion of a stylene-acrylic acid unit is represented by StAc part.

<Example of Production of Binder Resin 1>

(Formulation of PES Part [P-1])

| | |
|---|---|
| Bisphenol A ethylene oxide (2.2 mol adduct): | 46.5 mol % |
| Terephthalic acid: | 32.5 mol % |
| Adipic acid: | 6.5 mol % |
| Trimellitic anhydride: | 5.0 mol % |
| Fumaric acid: | 1.5 mol % |
| Acrylic acid: | 4.0 mol % |

80 parts by mass of the mixture of the above polyester monomer was loaded into a four-necked flask. The flask was mounted with a decompression device, a water separating device, a nitrogen gas introducing device, a temperature measuring device, and a stirring device, followed by stirring at 160° C. under nitrogen atmosphere. Then, a vinyl-based copolymer monomer (StAc part [S-1], styrene: 84.0 mol % and 2-ethylhexyl acrylate: 14.0 mol %) and 2.0 mol % of benzoyl peroxide as a polymerization initiator were mixed together and then 20 parts by mass of the resulting mixture was added through a drip filter for 4 hours. After that, the solution was reacted at 160° C. for 5 hours to heat up to 230° C., followed by addition of 0.2 mass % of dibutyl tin oxide with respect to the total amount of the polyester monomer component, thereby carrying out a condensation polymerization reaction for 6 hours. Further, the temperature thereof heated up to 240° C. and 2.0 mol % of ethylene glycol was added. Subsequently, a condensation polymerization reaction was carried out for 2 hours (condensation polymerization reaction 1) and then 2.0 mol % of stearic acid and 2 parts by mass of wax A (melting point: 75° C., the number of carbon atoms: 40, Cw/Cr=2.2, paraffin wax which is 750 of Mw) was added with respect to 100 parts by mass of resin, and a condensation polymerization reaction was carried out for another 2 hours (condensation polymerization reaction 2). After completing the reaction, the reaction product was then taken out of the container, cooled, and pulverized, thereby obtaining a binder resin 1 (see Tables 1 to 3).

Such production method as described above is adopted because the method is the best form for binding a long-chain monomer to a branched terminal which is a characteristic of the present invention. First, a vinyl-based copolymer monomer or an unsaturated polyester resin is subjected to an addition polymerization reaction in order that a main chain having a high molecular weight may be obtained. The control of the molecular weight of the main chain facilitates the obtainment of desired viscosity.

Next, raw material monomers for a polyester unit are subjected to a condensation polymerization reaction in two stages. In a first step, a monomer as a side chain is polymerized with a polymer as a main chain, whereby a branched polymer having a high degree of branching is produced. In a second step, a condensation polymerization reaction of a long-chain monomer is performed, thereby binding the long-chain monomer to the branched terminal.

The physical properties of the binder resin 1 are as shown in Table 4.

<Production Examples of Binder Resins 2 to 9>

Binder resins 2 to 9 were obtained by the same way as that of the production example of binder resin 1 except that the monomers and conditions were replaced with the monomers described in Tables 1 and 2 and the conditions described in Table 3. The physical properties of the binder resins 2 to 9 are listed in Table 4.

<Production Examples of Binder Resins 10 to 11>

80 parts by mass of the mixture (P-10 or P-11) of the polyester monomer described in Table 1 was loaded into a four-necked flask. The flask was mounted with a decompression device, a water separating device, a nitrogen gas introducing device, a temperature measuring device, and a stirring device, followed by stirring at 160° C. under nitrogen atmosphere. Then, a vinyl-based copolymer monomer described in Table 2 (S-1 or S-2) and benzoyl peroxide described in Table 3 as a polymerization initiator were mixed together and then 20 parts by mass of the resulting mixture was added through a drip filter for 4 hours. After that, the solution was reacted at 160° C. for 5 hours to heat up to 230° C., followed by addition of 0.2 mass % of dibutyl tin oxide with respect to the total amount of the polyester monomer component and the wax described in Table 3, thereby carrying out a condensation polymerization reaction for 6 hours. After completing the reaction, the reaction product was then taken out of the container, cooled, and pulverized, thereby obtaining a binder resins 10 to 11.

<Production Examples of Binder Resins 12 to 14>

A mixture of a polyester monomer (P-12, P-13 or P-14) and 0.2 part by mass of dibutyltin oxide with respect to 100 parts by mass of polyester monomer were loaded into a four-necked flask. The flask was mounted with a decompression device, a water separating device, a nitrogen gas introducing device, a temperature measuring device, and a stirring device. Then, under a nitrogen atmosphere, the temperature was increased to 230° C., and a condensation polymerization reaction was performed. Then, the wax described in Table 3 was added to the reaction product. After the completion of the reaction, the resultant was taken out of the container, cooled, and pulverized, whereby polyester resins 12 to 14 were obtained. The physical properties of those binder resins are as shown in Table 4.

<Production Examples of Binder Resins 15 to 16>

Xylene is loaded into a four-necked flask and then heated up to 120° C. The inside gas of the flask was sufficiently replaced with nitrogen and then stirred while dropping a mixture of the monomer (S-3 or S-4) described in Table 2 and benzoyl peroxide as a polymerization initiator described in Table 3 into the flask for 4 hours. In addition, the wax described in Table 3 was added to there. Further, after distillation removal of the solvent under reduced pressure is performed, binder resins 15 to 16 were obtained. Their physical properties are listed in Table 4.

Example 1

Preparation of Toner No. 1

| | |
|---|---|
| Binder Resin 1 | 70 parts by mass |
| Binder Resin 10 | 30 parts by mass |
| Magnetic iron oxide particles a (average particle size of 0.14 μm, Hc (magnetic resistance) = 11.5 kA/m, σs (saturation magnetization) = 90 $Am^2/kg$, σr (residual magnetization) = 16 $Am^2/kg$) | 90 parts by mass |
| Charge control agent-1(intrinsic viscosity of $1.5 \times 10^4$: $2.5 \times 10^{-1}$ dl/g, Mw: 27,000, Tg: 76° C., acid number: 25 mgKOH/g) | 2 parts by mass |

Figure 2:
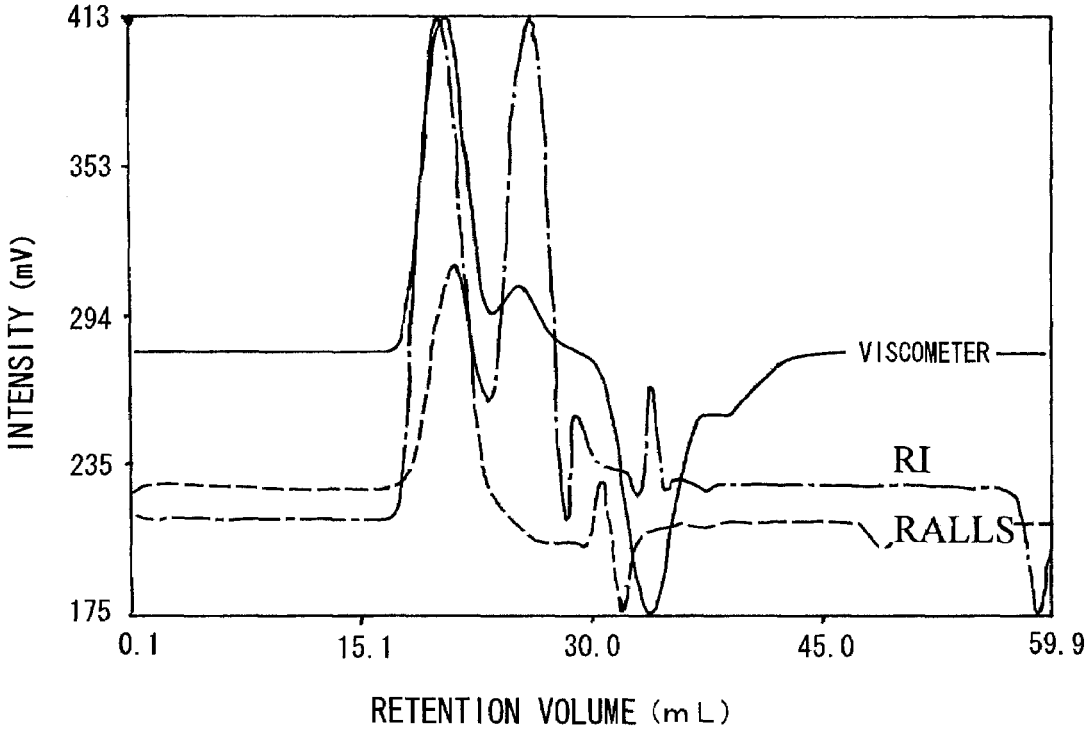
FIG. 2 is a diagram illustrating a chromatograph obtained by the GPC-RALLS-viscometer analysis of a toner No. 1 of Example 1.
Figure 3:
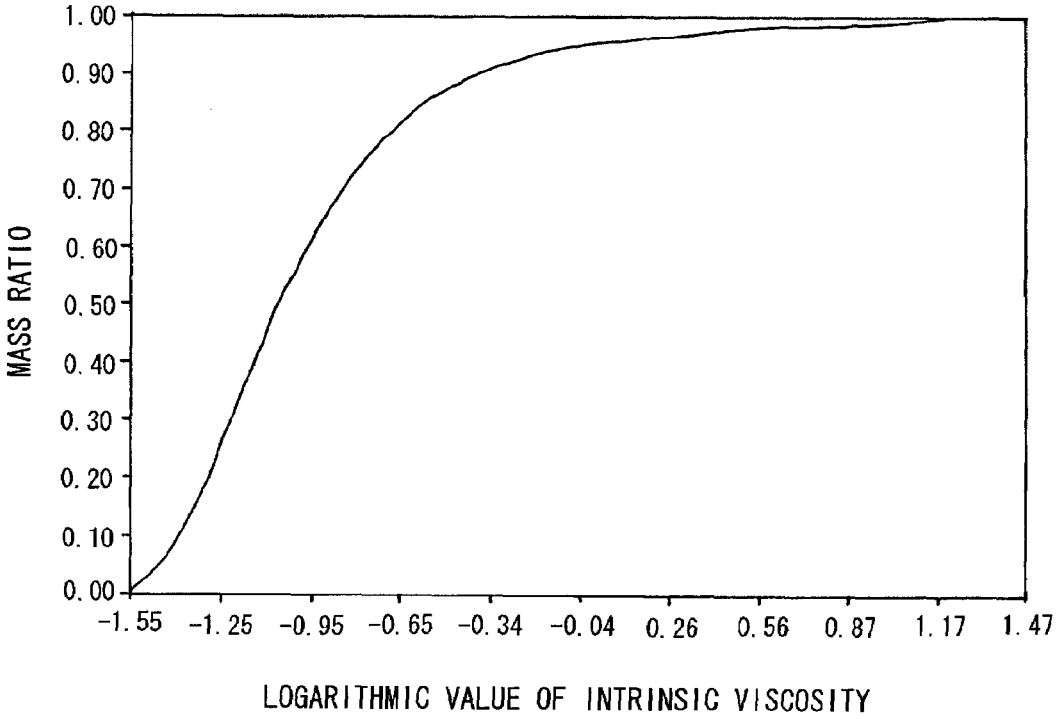
FIG. 3 is a diagram illustrating a relationship between an intrinsic viscosity of the toner No. 1 of Example 1 and an existing ratio thereof.
Figure 4:
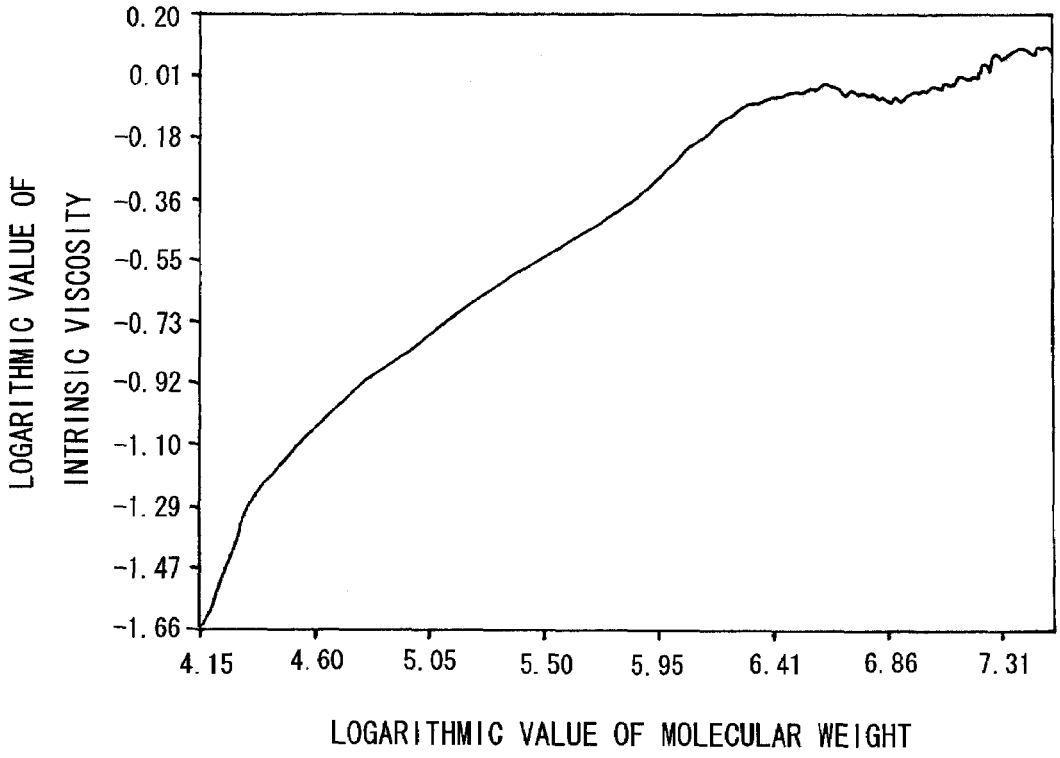
FIG. 4 is a diagram illustrating a relationship between a absolute molecular weight of the toner No. 1 of Example 1 and the intrinsic viscosity thereof.

After pre-mixing the above materials by a Henschel mixer, melt kneading was carried out using a biaxial kneading extruder. At this time, a holding time was controlled so that the temperature of the kneaded resin could reach 150° C. The resulting kneaded product was cooled and then roughly pulverized by a hammer mill, followed by further pulverizing by a turbo mill. The resulting pulverized fine powders were classified using a multi-division classifier utilizing the Coanda effect (Elbojet Classifier, manufactured by Nittetsuko K.K.), thereby obtaining toner particles with a weight average particle size of 6.8 μm. With respect to 100 parts by mass of the toner particles, 1.0 part by mass of hydrophobic silica fine particles (140 $m^2/g$ in specific surface area with nitrogen adsorption measured by the BET method) and 3.0 parts by mass of strontium titanate were externally added and filtrated through a 150-μm mesh, thereby obtaining toner No. 1. The toner internal formulation and the physical property values thereof are listed in Tables 5 and 6, respectively. In addition, the test results of toner No. 1 obtained by the GPS-PALLS-viscometer analysis device are shown in FIGS. 2 to 4.

In addition, the Charge control agent-1 is synthesized by using the following production method. 200 parts by mass of a methanol, 150 parts by mass of a 2-butanone and 50 parts by mass of a 2-propanol as a solvent, and, 78 parts by mass of a styrene, 15 parts by mass of an n-butyl acrylate and 7 parts by mass of a 2-acrylamide-2-methylpropanesulfonic acid as a monomer are added to a reaction vessel which can pressurize itself and equips a reflux pipe, an agitator, a thermometer, a nitrogen gas introducing pipe, a dropping device, and a decompression device, followed by heating up to 70° C. with stirring. Then, a solution obtained by diluting 1 part by mass of a 2,2'-azobis(2-methylbutyronitrile) as a polymerization initiator with 20 parts by mass of a 2-butanone was dropped into the reaction vessel for 1 hour, and the resultant solution was continually stirred for 5 hours, followed by further dropping the solution obtained by diluting 1 part by mass of a 2,2'-azobis(2-methylbutyronitrile) with 20 parts by mass of a 2-butanone into the reaction vessel for 30 minutes, and the resultant solution was continually stirred for 5 hours, then terminating a polymerization. After decompression removal of the polymerization solvent is performed, the resultant polymer was roughly pulverized below 100 μm by cutter mill equipped 150-μm mesh to obtain the Charge control agent-1.

<Toner Evaluation>

The above toner No. 1 was used and evaluated by a method as described below.

(1) Evaluation of Developability (Measurements of Image Density and Fogging)

The developability was evaluated from the results of determination of an image density and the generation of fogging.

A commercially-available copying machine (IR-6010, manufactured by Canon Inc.) was modified so that the printing speed thereof was increased 1.4 times and a fixing web was removed from a fixing unit. Such a copying machine was used to continuously print out 30,000 copies of a test chart (Office Planner SK paper from Canon Sales Co., Ltd.) with a print ratio of 4% in both environments of the environment of 23° C. and 5% RH (NL) and the environment of 32° C. and 80% RH (HH). An image density was measured such that a 1-cm-square image was subjected to a reflection density measurement and carried out by the Macbeth densitometer (manufactured by Macbeth Co., Ltd.) with a SPI filter. On the other hand, fogging was measured by a reflection densitometer (reflect meter model TC-6DS, manufactured by Tokyo Denshoku Co., Ltd.) and then evaluation was carried out such that the worst value of reflection density at the white part after the image formation was defined as DS, the average reflection density of a transfer material before the image formation was defined as Dr, and the amount of fogging was defined as DS-Dr. The smaller the value, the more favorable the fogging was suppressed. Their evaluations were carried out upon 30,000 sheets were printed. The results are shown in Table 7. A normal level was defined such that the image density after printing 30,000 sheets was 1.35 or more and the fogging was 1.5 or less.

(2) Evaluation of Image

Evaluations were carried out according to the device and the method used in the evaluation of the above developability. A test of continuously printing 30,000 copies of a test chart with a print ratio of 4% (Office Planner SK paper, manufactured by Canon Sales Co., Ltd.) in the environment of 32° C. and 80% RH (HH) was carried out and then the 30,000th image was visually observed to evaluate an image. The results are shown in Table 7. In the following evaluation criteria, there is no problem as far as the grade is B or more.

(Evaluation Criteria)

A. Any image defect such as a black dot, is not observed at all.

B. The number of black dots generated on the image is 4 or less.

C. The number of black dots generated on the image is 5 to 10.

D. The number of black dots generated on the image is 11 or more.

(3) Evaluation of Fixability

A fixing unit was removed from the commercially-available copying machine (IR-6010, manufactured by Canon Inc.) and then five 2-cm-square images were printed out on a sheet of A-4 paper (Office Planner SK paper, available from Canon Sales Co., Inc.) in an environment of normal temperature and normal humidity (23° C./60%). In this case, the loading amount of the unfixed image was 0.6 mg/cm$^2$. On the other hand, a fixing unit of a commercially-available laser beam printer (LaserJet 4300n, manufactured by Hewlett-Packard Co., Ltd.) was removed outside and modified so that it could move even outside the printer and could be voluntarily set to a fixing-roller temperature, a process speed, and a press pressure. The above unfixed image was sheet-fed through the modified fixing unit, thereby obtaining a fixed image. As the conditions of the sheet feeding, the fixing roller has a surface temperature of 140° C., a process speed of 1.1 times, and a press pressure of 12.0 kgf/cm$^2$. The fixed image was rubbed five times with a sheet of lens-cleaning paper (Lenz Cleaning Paper "Dasper®", manufactured by Ozu Paper Co., Ltd.) under a load of 50 g/cm$^2$. The fixed image was evaluated on the basis of a lowering rate (%) of the image densities of before and after the rubbing. Note that, the image densities were measured with the same method used in (1) above. The results are shown in Table 7. In the following evaluation criteria, it is problematic when the grade is B or below.

(Evaluation Criteria)

A: less than 10%

B: 10% or more to less than 15%

C: 15% or more to less than 20%

D: 20% or more (4) Evaluation of Twisted Offset

A fixing unit was removed from a commercially-available copying machine (IR-6010, manufactured by Canon Inc.) and then adjusted so that the load of toner was 1.0 mg/cm$^2$. Subsequently, as shown in FIG. 1, an unfixed image (print ratio: 10%) was prepared on a second original drawing sheet as thin paper. The image was evaluated such that it was fed through the fixing device which is set to a process speed of 50 mm/sec, a press pressure of 5.0 MPa, and a temperature regulation of 240° C. in an environment of high temperature and high humidity (32° C., 80% RH). The results are shown in Table 7. In the following evaluation criteria, it is problematic when the grade is C or below.

(Evaluation Criteria)

A: The generation of twisted offset is not observed.

B: Twist does not occur but paper is curled by sheet feeding and the generation of offset to the fixing roller occurs.

C: Twisted on fixing roller.

(5) Property of Inhibiting Adhesion of Ejected Sheets

The copying machine used in (1) was employed and a 2-cm-square image was printed on 100 sheets of a measurement test chart (A-4 paper (Office Planner SK sheet, available from Canon Sales Co., Inc.) loading amount of 0.6 mg/cm$^2$). An average transmission density of five points on the 100th sheet was measured by the Macbeth densitometer (manufactured by Macbeth Co., Ltd.) and provided as a value D1. Next, after 5,000 sheet-endurance, the 100th sheet was peeled off from the stacked sheets of paper and then the density measurement was simultaneously carried out as described above. The value at this time was defined as D2. The value of D1-D2 was calculated. Then, depending on the difference, the resulting values were classified as the following. The results are shown in Table 7. In the following evaluation criteria, it is problematic when the grade is C or below.

(Evaluation criteria)

A: Any peeling point or any white patch point is not observed.

B: Density reduction of 0.1 or more to less than 0.2.

C: Density reduction of 0.2 or more to less than 0.4.

D: Density reduction of 0.4 or more to less than 0.6.

E: Density reduction of 0.6 or more.

(6) Evaluation of Storage Stability

Ten grams of toner was weighed and placed in a 50-cc polyethylene cup. The cup was left standing in an incubator for 7 days at a temperature of 50° C. and a humidity of 20% while loading a 50-gram weight. After that, the blocking property of toner was evaluated by visual observation on the basis of the following evaluation criteria. The results are shown in Table 7. In the following evaluation criteria, it is problematic when the grade is B or below.

A: The toner does not aggregate at all.

B: The aggregate of the toner is present, but the aggregate is gradually reduced and collapsed as the cup is rotated.

C: The aggregate of the toner remains even after the cup has been rotated and the aggregate has been collapsed.

D: The aggregate of the toner is large and cannot be collapsed even by rotating the cup.

Examples 2 to 12

Preparation of Toner No. 2 to No. 12

Toners No. 2 to No. 12 were prepared in a manner similar to Example 1 with the formulations described in Table 5. The toner was evaluated by the same way as that of Example 1. The physical property values of the toner thus obtained are shown in Table 6 and the evaluation results are shown in Table 7.

Example 13

Preparation of Toner No. 13

| | |
|---|---|
| Binder Resin 1 | 20 parts by mass |
| Binder Resin 10 | 80 parts by mass |
| Charge control agent-2 | 2 parts by mass |
| Carbon black | 5 parts by mass |

Toner No. 13 was prepared by the same way as that of Example 1 except that the formulation of toner particles was changed as described above. The evaluation of toner was carried out in a manner as that of Example 1. The obtained physical property values of toner are shown in Table 6 and the evaluation results are shown in Table 7.

Further, the evaluation of a YMCK full-color one component development was carried out with the use of: magenta toner (M) using pigment red 57 instead of carbon black in the preparation of toner No. 13; yellow toner (Y) using pigment yellow 74 instead of carbon black in the preparation of toner No. 13; cyan toner (C) using pigment blue 15:3 instead of carbon black in the preparation of toner No. 13; and toner No. 13 (K). Each color toner showed good results with respect to the above evaluation criteria.

For the above charge control agent-2, the compound having the following structure (I) was used.

[Chem 2]

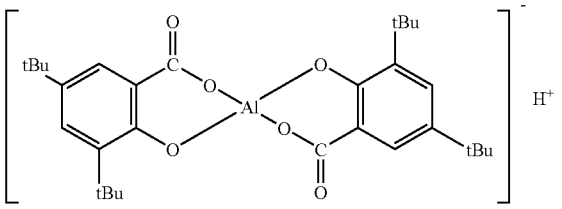

(I)

Example 14

Preparation of Toner No. 14

| | |
|---|---|
| Binder Resin 1 | 70 parts by mass |
| Binder Resin 10 | 30 parts by mass |
| Magnetic iron oxide particles a (average particle size of 0.14 μm, Hc = 11.5 kA/m, σs = 90 $Am^2/kg$, σr = 16 $Am^2/kg$) | 90 parts by mass |
| Charge control agent-1 (intrinsic viscosity of $1.5 \times 10^4$: $2.5 \times 10^{-1}$ dl/g, Mw: 27,000, Tg: 76° C., acid number: 25 mgKOH/g) | 2 parts by mass |
| Charge control agent-2 | 0.5 parts by mass |

Toner No. 14 was prepared by the same way as that of Example 1 except that the formulation of toner particles was changed as described above. The evaluation of toner was carried out in a manner as that of Example 1. The obtained physical property values of toner are shown in Table 6 and the evaluation results are shown in Table 7.

Comparative Examples 1 to 6

Toners No. 15 to No. 20 were prepared in a manner similar to that of Example 1 except the formulation of the toner particles was changed as described in Table 5. The toner was evaluated by the same way as that of Example 1. The physical property values of the toner thus obtained are shown in Table 6 and the evaluation results are shown in Table 7. In addition, a wax B used in place of the wax A used in the production of the binder resin described in Table 5 is Fischer-Tropsch wax of melting point: 108° C., the number of carbon atoms: 83, and Mw: 1,200. Further, a charge control agent-3 used in place of the charge control agent-1 has the structural formula (II) shown below.

Charge Control Agent-3

TABLE 1

[Chem 3]

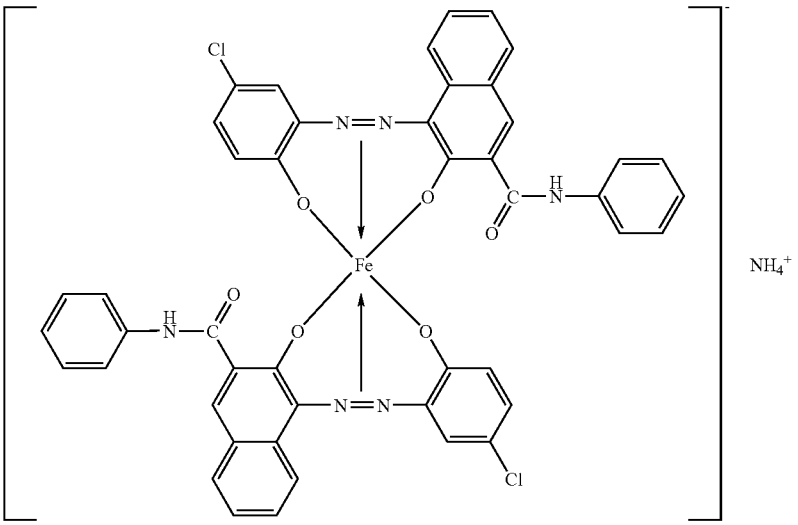

(II)

Tabulated resin compositions (PES part)

| | BPA-PO (mol %) | BPA-EO (mol %) | DSA (mol %) | TPA (mol %) | Adipic acid (mol %) | TMA (mol %) | FA (mol %) | Acrylic acid (mol %) | IPA (mol %) | Kind of additive/ ratio (mol %) |
|---|---|---|---|---|---|---|---|---|---|---|
| P-1 | — | 46.5 | — | 32.5 | 6.5 | 5.0 | 1.5 | 4.0 | — | — |
| P-2 | — | 46.5 | — | 32.5 | 6.5 | 5.0 | 1.5 | 4.0 | — | — |
| P-3 | — | 46.5 | — | 32.5 | 6.5 | 5.0 | 1.5 | 4.0 | — | — |
| P-4 | — | 47.5 | — | 32.5 | 6.5 | 5.0 | 1.5 | 4.0 | — | — |
| P-5 | — | 48.5 | — | 33.5 | 5.0 | 4.0 | 1.0 | 4.0 | — | — |
| P-6 | — | 48.5 | 1.0 | 33.0 | 5.5 | 3.0 | 1.0 | 4.0 | — | — |
| P-7 | — | 47.0 | — | 32.5 | 6.5 | 5.0 | 1.5 | 4.0 | — | — |
| P-8 | — | 43.5 | — | 30.5 | 5.5 | 5.0 | 1.5 | 4.0 | — | — |
| P-9 | — | 47.5 | — | 33.5 | 6.5 | 5.0 | 1.5 | 4.0 | — | — |
| P-10 | 22.5 | 27.5 | 2.5 | 42.0 | — | 2.0 | — | 3.5 | — | — |
| P-11 | 32.4 | 16.3 | 4.1 | 33.7 | 6.3 | 5.0 | — | 2.2 | — | — |
| P-12 | 22.5 | 25.5 | — | — | — | — | — | — | 48.0 | E/4.0 |
| P-13 | 24.1 | 27.5 | — | 43.0 | — | 5.0 | — | — | — | F/0.4 |
| P-14 | 23.5 | 26.5 | — | 45.0 | — | 5.0 | — | — | — | — |

BPA-PO: bis-phenol-A propylene oxide additive
BPA-EO: bis-phenol-A ethylene oxide additive
DSA: dodecenyl succinic acid
TPA: terephthalic acid
TMA: trimellitic anhydride
FA: fumaric acid
IPA: isophthalic acid
A: stearic acid
B: arachidic acid
C: palmitic acid
D: octadecyl alcohol
E: isophorone diisocyanate
F: acid-modified polypropylene wax

TABLE 2

Tabulated resin compositions (StAc part)

| | St | 2EHA | BA | DVB | Kind of additive/ ratio |
|---|---|---|---|---|---|
| S-1 | 84.0 mol % | 14.0 mol % | — | — | — |
| S-2 | 89.0 mol % | 7.0 mol % | — | — | — |
| S-3 | 87.8 mol % | — | 10.0 mol % | — | F/0.2 mol % |
| S-4 | 73 parts by mass | — | 26.5 parts by mass | 0.004 parts by mass | — |

St: styrene

2EHA: 2-ethylhexyl acrylate

BA: butyl acrylate

DVB: dibutyl benzene

F: acid-modified polypropylene wax

TABLE 3

Method of producing binder resin

| | PES part/ addition amount | StAc part/ addition amount | Ratio of benzoyl peroxide | Condensation polymerization 1 Kind of additive/ratio | Condensation polymerization 2 Kind of additive/ratio | Wax/ Addition amount |
|---|---|---|---|---|---|---|
| Binder Resin 1 | P-1/80 | S-1/20 | 2.0 mol % | EG/2.0 mol % | Stearic acid/2.0 mol % | Wax A/ 2.0 parts by mass |
| Binder Resin 2 | P-2/80 | S-1/20 | 2.0 mol % | EG/2.0 mol % | Arachidic acid/2.0 mol % | Wax A/ 2.0 parts by mass |
| Binder Resin 3 | P-3/80 | S-1/20 | 2.0 mol % | EG/2.0 mol % | Palmitic acid/2.0 mol % | Wax A/ 2.0 parts by mass |
| Binder Resin 4 | P-4/80 | S-1/20 | 2.0 mol % | — | Octadecyl alcohol/ 3.0 mol % | Wax A/ 2.0 parts by mass |
| Binder Resin 5 | P-5/80 | S-1/20 | 2.0 mol % | EG/2.0 mol % | Stearic acid/2.0 mol % | Wax A/ 2.0 parts by mass |
| Binder Resin 6 | P-6/80 | S-1/20 | 2.0 mol % | EG/2.0 mol % | Stearic acid/2.0 mol % | Wax A/ 2.0 parts by mass |
| Binder Resin 7 | P-7/80 | S-1/20 | 2.0 mol % | EG/1.5 mol % Palmitic acid/2.0 mol % | — | Wax A/ 2.0 parts by mass |
| Binder Resin 8 | P-8/80 | S-1/20 | 2.0 mol % | EG/5.0 mol % | Stearic acid/5.0 mol % | Wax A/ 2.0 parts by mass |
| Binder Resin 9 | P-9/80 | S-1/20 | 2.0 mol % | EG/1.0 mol % | Stearic acid/1.0 mol % | Wax B/ 2.0 parts by mass |
| Binder Resin 10 | P-10/80 | S-2/20 | 4.0 mol % | — | — | Wax A/ 2.0 parts by mass |
| Binder Resin 11 | P-11/80 | S-1/20 | 2.0 mol % | — | — | Wax A/ 2.0 parts by mass |
| Binder Resin 12 | P-12/100 | — | — | — | — | Wax A/ 2.0 parts by mass |
| Binder Resin 13 | P-13/100 | — | — | — | — | Wax B/ 2.0 parts by mass |
| Binder Resin 14 | P-14/100 | — | — | — | — | Wax B/ 2.0 parts by mass |
| Binder Resin 15 | — | S-3/100 | 2.0 mol % | — | — | Wax B/ 2.0 parts by mass |
| Binder Resin 16 | — | S-4/100 | 0.5 parts by mass | — | — | Wax A/ 2.0 parts by mass, Wax B/ 2.0 parts by mass |

EG: ethylene glycol

TABLE 4

Tabulated physical properties of binder resin

| | Results of GPC-RALLS-viscometer analysis | | | | | | | | | |
|---|---|---|---|---|---|---|---|---|---|---|
| | Intrinsic viscosity Ratio of $5.0 \times 10^{-2}$ dl/g or less | Intrinsic viscosity Ratio of $1.5 \times 10^{-1}$ dl/g or more | Intrinsic viscosity at absolute molecular weight | Intrinsic viscosity at absolute molecular weight | Molecular weight distribution | | | Inertial square radius | Softening | |
| | [mass %] | [mass %] | of $1.5 \times 10^{4}$ [dl/g] | of $1.0 \times 10^{5}$ [dl/g] | Mp | Mw | Mw/Mn | Rg [nm] | point (° C.) | Tg (° C.) |
| Binder Resin 1 | 3.5 | 42.3 | $6.2 \times 10^{-2}$ | $2.8 \times 10^{-1}$ | 20510 | $1.02 \times 10^{6}$ | 39.0 | 15.2 | 121.3 | 51.3 |
| Binder Resin 2 | 3.1 | 43.2 | $7.5 \times 10^{-2}$ | $3.0 \times 10^{-1}$ | 23100 | $1.23 \times 10^{6}$ | 38.0 | 15.4 | 122.7 | 52.1 |
| Binder Resin 3 | 3.8 | 41.1 | $5.3 \times 10^{-2}$ | $2.7 \times 10^{-1}$ | 19500 | $9.80 \times 10^{5}$ | 35.0 | 15.0 | 120.1 | 51.1 |
| Binder Resin 4 | 3.5 | 42.1 | $6.3 \times 10^{-2}$ | $2.8 \times 10^{-1}$ | 20321 | $1.00 \times 10^{6}$ | 38.0 | 15.0 | 121.3 | 51.3 |
| Binder Resin 5 | 4.2 | 39.7 | $5.1 \times 10^{-2}$ | $2.5 \times 10^{-1}$ | 19000 | $9.54 \times 10^{5}$ | 34.0 | 16.2 | 119.2 | 51.0 |
| Binder Resin 6 | 5.8 | 37.4 | $5.0 \times 10^{-2}$ | $2.4 \times 10^{-1}$ | 18700 | $9.32 \times 10^{5}$ | 34.0 | 16.6 | 118.7 | 50.8 |
| Binder Resin 7 | 1.8 | 48.6 | $9.2 \times 10^{-2}$ | $3.0 \times 10^{-1}$ | 25400 | $2.52 \times 10^{6}$ | 43.0 | 14.6 | 126.4 | 53.2 |
| Binder Resin 8 | 7.2 | 35.2 | $5.0 \times 10^{-2}$ | $2.1 \times 10^{-1}$ | 18500 | $9.12 \times 10^{5}$ | 33.0 | 17.2 | 117.5 | 50.9 |
| Binder Resin 9 | 1.8 | 53.2 | $9.5 \times 10^{-2}$ | $3.4 \times 10^{-1}$ | 26300 | $2.84 \times 10^{6}$ | 44.0 | 13.2 | 125.3 | 53.6 |
| Binder Resin 10 | 31.2 | 2.6 | $1.5 \times 10^{-2}$ | — | 10820 | 12700 | 1.1 | 4.8 | 95.3 | 52.1 |
| Binder Resin 11 | 0.0 | 88.4 | $1.0 \times 10^{-1}$ | $3.8 \times 10^{-1}$ | 28510 | $4.50 \times 10^{6}$ | 38.0 | 18.3 | 135.8 | 54.3 |
| Binder Resin 12 | 15.2 | 12.1 | $1.0 \times 10^{-1}$ | $1.8 \times 10^{-1}$ | 22100 | $2.70 \times 10^{6}$ | 37.0 | 17.4 | 125.1 | 52.1 |
| Binder Resin 13 | 14.2 | 9.2 | $1.1 \times 10^{-1}$ | $1.9 \times 10^{-1}$ | 23000 | $3.20 \times 10^{6}$ | 39.0 | 17.6 | 121.3 | 53.4 |
| Binder Resin 14 | 8.6 | 9.5 | $1.2 \times 10^{-1}$ | $2.0 \times 10^{-1}$ | 24100 | $4.10 \times 10^{6}$ | 38.0 | 15.5 | 120.0 | 51.1 |
| Binder Resin 15 | 0.0 | 71.4 | $2.0 \times 10^{-1}$ | $4.2 \times 10^{-1}$ | 28300 | $5.32 \times 10^{6}$ | 41.0 | 23.5 | 135.2 | 57.5 |
| Binder Resin 16 | 6.3 | 80.4 | $2.4 \times 10^{-1}$ | $8.8 \times 10^{-1}$ | 32500 | $9.85 \times 10^{6}$ | 45.0 | 42.1 | 140.3 | 58.6 |

TABLE 5

Toner formulations

| | Toner No. | Binder resin (1) | Binder resin (2) | Binder Resin mixing ratio (1)/(2) | Charge control agent | Wax | Magnetic iron-oxide particles |
|---|---|---|---|---|---|---|---|
| Example 1 | 1 | Binder Resin 1 | Binder Resin 10 | 70/30 | 1 | A | a |
| Example 2 | 2 | Binder Resin 2 | Binder Resin 10 | 70/30 | 1 | A | a |
| Example 3 | 3 | Binder Resin 3 | Binder Resin 10 | 70/30 | 1 | A | a |
| Example 4 | 4 | Binder Resin 4 | Binder Resin 10 | 70/30 | 1 | A | a |
| Example 5 | 5 | Binder Resin 5 | Binder Resin 10 | 70/30 | 1 | A | a |
| Example 6 | 6 | Binder Resin 6 | Binder Resin 10 | 70/30 | 1 | A | a |
| Example 7 | 7 | Binder Resin 7 | Binder Resin 10 | 70/30 | 1 | A | a |
| Example 8 | 8 | Binder Resin 8 | Binder Resin 10 | 70/30 | 1 | A | a |
| Example 9 | 9 | Binder Resin 9 | Binder Resin 10 | 70/30 | 1 | A | a |
| Example 10 | 10 | Binder Resin 1 | Binder Resin 10 | 90/10 | 1 | A | a |
| Example 11 | 11 | Binder Resin 1 | Binder Resin 10 | 30/70 | 1 | A | a |
| Example 12 | 12 | Binder Resin 9 | Binder Resin 10 | 70/30 | 3 | B | a |
| Example 13 | 13 | Binder Resin 1 | Binder Resin 10 | 20/80 | 2 | A | — |
| Example 14 | 14 | Binder Resin 1 | Binder Resin 10 | 70/30 | 1, 2 | A | a |
| Comparative Example 1 | 15 | Binder Resin 11 | Binder Resin 10 | 70/30 | 1 | A | a |
| Comparative Example 2 | 16 | Binder Resin 12 | — | 100/0 | 1 | A | a |
| Comparative Example 3 | 17 | Binder Resin 13 | — | 100/0 | 1 | B | a |
| Comparative Example 4 | 18 | Binder Resin 14 | — | 100/0 | 3 | B | a |

TABLE 5-continued

| | Toner formulations | | | | | | |
|---|---|---|---|---|---|---|---|
| | Toner No. | Binder resin (1) | Binder resin (2) | Binder Resin mixing ratio (1)/(2) | Charge control agent | Wax | Magnetic iron-oxide particles |
| Comparative Example 5 | 19 | Binder Resin 15 | — | 100/0 | 3 | B | a |
| Comparative Example 6 | 20 | Binder Resin 16 | — | 100/0 | 3 | B | a |

TABLE 6

| | Physical properties of toner | | | | | | | | | | |
|---|---|---|---|---|---|---|---|---|---|---|---|
| | Results of GPC-RALLS-viscometer analysis | | | | | | | | | | |
| | Intrinsic viscosity Ratio of $5.0 \times 10^{-2}$ dl/g or less | Intrinsic viscosity Ratio of $1.5 \times 10^{-1}$ dl/g or more | Intrinsic viscosity at absolute molecular weight of | Intrinsic viscosity at absolute molecular weight of | Molecular weight distribution | | | Radius of inertia | Softening point | Tg | THF Insoluble amount |
| | [mass %] | [mass %] | $1.5 \times 10^{4}$ [dl/g] | $1.0 \times 10^{5}$ [dl/g] | Mp | Mw | Mw/Mn | Rg [nm] | [° C.] | [° C.] | [mass %] |
| Example 1 | 20.9 | 27.9 | $2.5 \times 10^{-2}$ | $1.6 \times 10^{-1}$ | 20510 | $8.12 \times 10^{5}$ | 33.1 | 11.3 | 118.5 | 54.2 | 22.0 |
| Example 2 | 18.1 | 28.2 | $4.6 \times 10^{-2}$ | $1.8 \times 10^{-1}$ | 23100 | $8.43 \times 10^{5}$ | 34.1 | 15.2 | 120.5 | 54.7 | 25.0 |
| Example 3 | 23.2 | 25.2 | $2.0 \times 10^{-2}$ | $1.5 \times 10^{-1}$ | 19500 | $7.90 \times 10^{5}$ | 35.0 | 10.5 | 117.4 | 53.2 | 21.5 |
| Example 4 | 21.2 | 27.6 | $2.4 \times 10^{-2}$ | $1.6 \times 10^{-1}$ | 20310 | $8.06 \times 10^{5}$ | 32.5 | 11.1 | 118.4 | 54.1 | 21.9 |
| Example 5 | 27.3 | 24.3 | $1.8 \times 10^{-2}$ | $1.4 \times 10^{-1}$ | 19000 | $6.84 \times 10^{5}$ | 34.0 | 16.2 | 116.8 | 52.8 | 19.2 |
| Example 6 | 36.7 | 22.4 | $1.2 \times 10^{-2}$ | $1.2 \times 10^{-1}$ | 18700 | $6.21 \times 10^{5}$ | 34.0 | 17.4 | 116.1 | 51.8 | 18.8 |
| Example 7 | 15.2 | 37.8 | $5.2 \times 10^{-2}$ | $1.8 \times 10^{-1}$ | 25400 | $9.25 \times 10^{5}$ | 43.0 | 11.3 | 124.1 | 53.8 | 26.1 |
| Example 8 | 38.4 | 21.8 | $1.2 \times 10^{-2}$ | $1.1 \times 10^{-1}$ | 18500 | $8.33 \times 10^{5}$ | 33.0 | 17.2 | 114.2 | 51.2 | 17.6 |
| Example 9 | 15.6 | 39.1 | $6.1 \times 10^{-2}$ | $1.9 \times 10^{-1}$ | 26300 | $1.02 \times 10^{6}$ | 44.0 | 9.8 | 123.4 | 53.1 | 25.7 |
| Example 10 | 15.3 | 30.3 | $3.1 \times 10^{-2}$ | $1.8 \times 10^{-1}$ | 21500 | $8.33 \times 10^{5}$ | 34.0 | 14.2 | 120.0 | 54.6 | 24.7 |
| Example 11 | 48.9 | 21.3 | $1.1 \times 10^{-2}$ | $1.0 \times 10^{-1}$ | 17500 | $6.98 \times 10^{5}$ | 31.2 | 10.8 | 111.2 | 52.4 | 17.4 |
| Example 12 | 15.0 | 40.0 | $6.2 \times 10^{-2}$ | $1.9 \times 10^{-1}$ | 26300 | $1.02 \times 10^{6}$ | 44.0 | 9.8 | 123.4 | 53.1 | 32.2 |
| Example 13 | 49.1 | 20.9 | $1.0 \times 10^{-2}$ | $1.0 \times 10^{-1}$ | 17400 | $6.51 \times 10^{5}$ | 32.1 | 10.4 | 108.9 | 52.0 | 16.8 |
| Example 14 | 21.4 | 27.6 | $2.4 \times 10^{-2}$ | $1.6 \times 10^{-1}$ | 20000 | $7.92 \times 10^{5}$ | 32.1 | 11.8 | 119.5 | 54.4 | 27.8 |
| Comparative Example 1 | 6.7 | 19.7 | $7.6 \times 10^{-2}$ | $2.0 \times 10^{-1}$ | 29100 | $1.23 \times 10^{6}$ | 43.2 | 20.5 | 128.3 | 54.2 | 36.1 |
| Comparative Example 2 | 16.2 | 14.2 | $9.8 \times 10^{-2}$ | $1.6 \times 10^{-1}$ | 23200 | $2.80 \times 10^{6}$ | 44.2 | 23.1 | 120.0 | 53.0 | 4.7 |
| Comparative Example 3 | 15.6 | 10.2 | $1.1 \times 10^{-1}$ | $1.9 \times 10^{-1}$ | 24100 | $3.50 \times 10^{6}$ | 43.2 | 24.5 | 117.2 | 53.1 | 19.8 |
| Comparative Example 4 | 10.2 | 10.4 | $1.1 \times 10^{-1}$ | $1.8 \times 10^{-1}$ | 24800 | $4.47 \times 10^{6}$ | 48.6 | 21.5 | 114.2 | 51.1 | 18.1 |
| Comparative Example 5 | 0.7 | 75.6 | $1.9 \times 10^{-1}$ | $3.3 \times 10^{-1}$ | 28300 | $4.85 \times 10^{6}$ | 47.5 | 35.2 | 132.5 | 58.8 | 1.8 |
| Comparative Example 6 | 5.8 | 81.5 | $2.6 \times 10^{-1}$ | $9.1 \times 10^{-1}$ | 32500 | $9.85 \times 10^{6}$ | 49.2 | 48.3 | 140.2 | 60.1 | 41.2 |

TABLE 7

| | Evaluation results | | | | | | | | |
|---|---|---|---|---|---|---|---|---|---|
| | Endurance stability with web-less and oilless | | | | | Frameless printing | Prevention of ejected | | |
| | HH | | NL | | | Twisted offset | paper | Image | Storage |
| | Density | Fogging | Density | Fogging | Fixability | property | adhesion | evaluation | stability |
| Example 1 | 1.45 | 0.7 | 1.43 | 0.8 | A | A | A | A | A |
| Example 2 | 1.45 | 0.9 | 1.42 | 1.2 | A | A | A | A | A |
| Example 3 | 1.46 | 0.8 | 1.42 | 0.8 | A | A | A | A | A |
| Example 4 | 1.46 | 0.7 | 1.43 | 0.8 | A | A | A | A | A |
| Example 5 | 1.42 | 0.8 | 1.42 | 0.9 | A | A | A | A | A |
| Example 6 | 1.41 | 0.4 | 1.41 | 1.3 | A | A | A | A | A |
| Example 7 | 1.36 | 1.1 | 1.39 | 1.4 | A | A | A | A | A |
| Example 8 | 1.41 | 0.8 | 1.40 | 0.9 | A | B | B | A | A |
| Example 9 | 1.35 | 1.2 | 1.38 | 1.4 | A | A | A | B | A |
| Example 10 | 1.46 | 0.8 | 1.42 | 1.0 | A | A | A | B | A |
| Example 11 | 1.45 | 0.7 | 1.43 | 0.8 | A | B | B | A | A |

TABLE 7-continued

| | Evaluation results | | | | | | | | |
|---|---|---|---|---|---|---|---|---|---|
| | Endurance stability with web-less and oilless | | | | | Frameless printing | Prevention of ejected | | |
| | HH | | NL | | | Twisted offset | paper | Image | Storage |
| | Density | Fogging | Density | Fogging | Fixability | property | adhesion | evaluation | stability |
| Example 12 | 1.43 | 1.5 | 1.40 | 1.8 | A | A | A | B | A |
| Example 13 | 1.45 | 0.9 | 1.42 | 1.2 | A | B | B | A | A |
| Example 14 | 1.52 | 0.5 | 1.51 | 0.5 | A | A | A | A | A |
| Comparative Example 1 | 1.30 | 1.0 | 1.34 | 1.8 | B | C | C | C | B |
| Comparative Example 2 | 1.28 | 1.3 | 1.32 | 2.0 | B | C | D | B | B |
| Comparative Example 3 | 1.25 | 1.6 | 1.31 | 2.3 | B | C | E | B | B |
| Comparative Example 4 | 1.22 | 1.5 | 1.27 | 2.4 | B | C | E | B | B |
| Comparative Example 5 | 1.18 | 1.6 | 1.21 | 2.2 | C | C | D | D | C |
| Comparative Example 6 | 1.12 | 2.2 | 1.15 | 2.6 | D | C | D | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-277384, filed Oct. 11, 2006, which is hereby incorporated by reference herein in its entirety.

What is claimed is:

1. A toner comprising toner particles comprising at least a binder resin comprising at least a high-molecular weight resin having a weight average molecular weight from $5\times10^5$ to $3\times10^6$ with a linear alkyl chain at a terminal end thereof, and a colorant, wherein, when the toner is dissolved in a tetrahydrofuran (THF) solvent at 25° C. for 24 hours, the amount of a THF-soluble matter having an intrinsic viscosity of $5.0\times10^{-2}$ dl/g or less with respect to the total amount of the THF-soluble matter in a GPC-RALLS-viscometer analysis is 15.0 mass % to 60.0 mass %, and the amount of a THF-soluble matter having an intrinsic viscosity of $1.5\times10^{-1}$ dl/g or more with respect to the total amount of the THF-soluble matter in a GPC-RALLS-viscometer analysis is 22.4 mass % to 37.8 mass % and a molecular weight Mp of a peak top of a main peak of a THF-soluble matter in a GPC-RALLS-viscometer analysis, when the toner is dissolved in a THF solvent at 25° C. for 24 hours, is 18,700 to 25,400.

2. A toner according to claim 1, wherein, when the toner is dissolved in a THF solvent at 25° C. for 24 hours, an intrinsic viscosity of a THF-soluble matter having an absolute molecular weight of $1.5\times10^4$ in a GPC-RALLS-viscometer analysis is $5.0\times10^{-3}$ dl/g to $1.0\times10^{-1}$ dl/g.

3. A toner according to claim 1, wherein, when the toner is dissolved in a THF solvent at 25° C. for 24 hours, an intrinsic viscosity of a THF-soluble matter having an absolute molecular weight of $1.0\times10^5$ in a GPC-RALLS-viscometer analysis is $1.0\times10^{-1}$ dl/g to $2.0\times10^{-1}$ dl/g.

4. A toner according to claim 1, wherein, when the toner is dissolved in a THF solvent at 25° C. for 24 hours, an intrinsic viscosity of a THF-soluble matter having an absolute molecular weight of $1.5\times10^4$ in a GPC-RALLS-viscometer analysis is $1.0\times10^{-2}$ dl/g to $6.0\times10^{-2}$ dl/g.

5. A toner according to claim 1, wherein, when the toner is dissolved in a THF solvent at 25° C. for 24 hours, an intrinsic viscosity of a THF-soluble matter having an absolute molecular weight of $1.0\times10^5$ in a GPC-RALLS-viscometer analysis is $1.2\times10^{-1}$ dl/g to $2.0\times10^{-1}$ dl/g.

6. A toner according to claim 1, wherein the binder resin comprise at least a hybrid resin in which a polyester unit and a vinyl copolymerization unit are chemically bound.

7. A toner according to claim 1, wherein the high-molecular weight resin is a branched polyester resin, wherein a linear carboxylic acid having 10 to 30 carbon atoms or a linear alcohol having 10 to 30 carbon atoms is bound to the end of the branched polyester resin.

* * * * *